US010710394B2

(12) United States Patent
Dietemann et al.

(10) Patent No.: US 10,710,394 B2
(45) **Date of Patent: *Jul. 14, 2020**

(54) SECURE ITEM COMPRISING A REVEALING SCREEN AND A COMBINED IMAGE

(71) Applicant: OBERTHUR FIDUCIAIRE SAS, Paris (FR)

(72) Inventors: Philippe Dietemann, Saint Martin d'heres (FR); Fernand Garcia De Cruz, Asnières sur Seine (FR)

(73) Assignee: OBERTHUR FIDUCIAIRE SAS, Paris (FR)

( * ) Notice: Subject to any disclaimer, the term of this patent is extended or adjusted under 35 U.S.C. 154(b) by 105 days.

This patent is subject to a terminal disclaimer.

(21) Appl. No.: 16/066,395

(22) PCT Filed: Dec. 23, 2016

(86) PCT No.: PCT/EP2016/082651
§ 371 (c)(1),
(2) Date: Jun. 27, 2018

(87) PCT Pub. No.: WO2017/114803
PCT Pub. Date: Jul. 6, 2017

(65) Prior Publication Data

US 2019/0039402 A1 Feb. 7, 2019

(30) Foreign Application Priority Data

Dec. 29, 2015 (FR) ..... 15 63426

(51) Int. Cl.
*B42D 25/342* (2014.01)
*B42D 25/20* (2014.01)
(Continued)

(52) U.S. Cl.
CPC ..... *B42D 25/342* (2014.10); *B42D 25/20* (2014.10); *B42D 25/351* (2014.10);
(Continued)

(58) Field of Classification Search
CPC .... B42D 25/342; B42D 25/20; B42D 25/351; B42D 25/355; B42D 25/373; B42D 25/378; B42D 25/364
See application file for complete search history.

(56) References Cited

U.S. PATENT DOCUMENTS 2,021,141 A 11/1935 Boyer
5,118,526 A 6/1992 Allen et al.
(Continued)

FOREIGN PATENT DOCUMENTS

CA 2471379 A1 7/2003
EP 0203499 A2 12/1986
(Continued)

OTHER PUBLICATIONS

Corresponding International Application, International Search Report, Application No. PCT/EP2016/082651, dated Mar. 15, 2017, 6 pages.

*Primary Examiner* — Dominic E Rego
(74) *Attorney, Agent, or Firm* — Cooper Legal Group, LLC; Ronald M. Kachmarik

(57) ABSTRACT

A secure item including a revealing screen and a combined image, or an assembly comprising a secure item and another object. The secure item including one of the revealing screen and the combined image, and the object including or forming the other one of the revealing screen and the combined image. The combined image being made up of a plurality of interlaced images each interlaced image and/or the revealing screen being made up of a plurality of elements. The revealing screen making it possible, when placed on top of
(Continued)

the combined image, to observe various revealed images by moving the revealing screen relative to the combined image and/or by changing the observation angle, the revealed images each including a certain proportion of each interlaced image, and the elements being made up of one or more micro-patterns.

20 Claims, 12 Drawing Sheets

(51) Int. Cl.

| | |
|---|---|
| ***B42D 25/355*** | (2014.01) |
| ***B42D 25/351*** | (2014.01) |
| ***B42D 25/378*** | (2014.01) |
| ***B42D 25/373*** | (2014.01) |
| *B42D 25/364* | (2014.01) |

(52) U.S. Cl.
CPC ..... *B42D 25/355* (2014.10); *B42D 25/373* (2014.10); *B42D 25/378* (2014.10); *B42D 25/364* (2014.10)

(56) References Cited

U.S. PATENT DOCUMENTS

| | | | | |
|---|---|---|---|---|
| 7,609,451 | B1 * | 10/2009 | Scarbrough | B44F 1/10 359/619 |
| 10,132,699 | B1 * | 11/2018 | Pillars | G01L 1/125 |
| 2008/0021381 | A1 * | 1/2008 | Lurvey | A61M 39/02 604/85 |
| 2009/0197187 | A1 * | 8/2009 | Yamauchi | G03F 7/001 430/2 |
| 2010/0001508 | A1 * | 1/2010 | Tompkin | B42D 25/333 283/85 |
| 2010/0307705 | A1 * | 12/2010 | Rahm | B42D 25/29 162/140 |
| 2011/0045248 | A1 * | 2/2011 | Hoffmuller | B41M 1/04 428/156 |
| 2011/0109078 | A1 * | 5/2011 | Hoffmuller | B42D 25/342 283/72 |
| 2012/0174447 | A1 * | 7/2012 | Vincent | B42D 25/355 40/453 |
| 2012/0188400 | A1 * | 7/2012 | Smith | H01L 27/14621 348/223.1 |
| 2015/0301234 | A1 * | 10/2015 | Bin-Nun | H04N 1/00201 359/619 |

FOREIGN PATENT DOCUMENTS

| | | | |
|---|---|---|---|
| EP | 0229645 | A1 | 7/1987 |
| EP | 1252389 | A1 | 10/2002 |
| EP | 1389537 | A1 | 2/2004 |
| EP | 2367695 | A2 | 9/2011 |
| EP | 2585308 | A1 | 5/2013 |
| EP | 2740607 | A1 | 6/2014 |
| FR | 2961621 | A1 | 12/2011 |
| FR | 3005068 | A1 | 10/2014 |
| GB | 1552853 | | 9/1979 |
| WO | 2004096482 | A1 | 11/2004 |
| WO | 2004113954 | A2 | 12/2004 |
| WO | 2008006983 | A1 | 1/2008 |
| WO | 2014096794 | A1 | 6/2014 |

* cited by examiner

SECURE ITEM COMPRISING A REVEALING SCREEN AND A COMBINED IMAGE

BACKGROUND

In order to guard against forgeries or falsifications and in order to increase the security level, it is known to use security elements applied on the surface or introduced hulk-wise or as window(s) into a secure item, for example a label, a packaging, especially for medicines, foods, cosmetics, electronic parts or spare parts.

The secure item may in particular be chosen from among a payment means, such as a banknote, a bank card, a check or a restaurant voucher, an identity document such as an identity card, a visa, a passport or a driver's license, a secure card, a lottery ticket, a transport pass or else an entry ticket for shows.

Effects of masking of interlaced images by a revealing raster allowing, when the revealing raster and the image are superposed, the observation of an image by displacing the revealing raster with respect to the image or by changing the angle of observation, are known from patent applications EP 2 367 695, EP 2 585 308 and EP 2 586 014 and from patent EP 2 454 102.

However, these patents present interlaced images in the form of solid lines.

Also known from patent application EP 2 740 607 is a system comprising a revealing raster, a layer exhibiting pigments orientable by an external magnetic field and a magnetic layer exhibiting a raster of North and South poles, the revealing raster and the raster of North and South poles being of different colors. WO 2014 096 794 describes a first raster on which a second surface raster is embossed, the raster lines of the first raster exhibiting one and the same color in visible light and different colors when they are observed under a combination of visible light and invisible light and the two rasters being such that the device exhibits a different color, according to the angle of observation, when it is exposed to a combination of visible light and invisible light.

SUMMARY

A need exists to benefit from secure items comprising an anti-forgery optical system using the tools of the players in the field of secure items, which is capable of producing optical effects able to contribute to the authentication and/or the identification of the item, and whose possible incorporation in an item such as a paper may be done relatively easily.

The invention is aimed at answering this need and a subject thereof is, according to a first of its aspects, a secure item comprising a revealing raster and a combined image, or an assembly comprising a secure item and another object, the secure item comprising one of the revealing raster and of the combined image and the object comprising or forming the other of the revealing raster and of the combined image, the combined image being composed of a plurality of interlaced images, each interlaced image and/or the revealing raster being composed of a plurality of elements, the revealing raster making it possible, when it is superposed with the combined image, to observe different images revealed by displacement, when the revealing raster and the combined image are superposed, for at least one given position and given orientation of the revealing raster with respect to the combined image, and/or by changing the angle of observation, the revealed images each comprising a certain proportion of each interlaced image, and one element at least being composed of one or more micropatterns.

The fact that the elements are composed of micropatterns makes it possible to strengthen the security of the item. Indeed, the presence of the micropatterns imposes a high resolution of the combined image and/or of the revealing raster and, therefore, renders forgery of the secure item more difficult.

By virtue of the invention, it is possible to benefit from a secure item offering a novel means of authentication, consisting of the formation of different revealed images, leading for example to the formation of a particular colored pattern easily recognizable by the man in the street.

The aforementioned other object is for example similar in its function and/or in its shape to the secure item according to the invention. For example, the secure item and the other object are banknotes, especially with the same fiduciary value. The secure item and the other object may then be differentiated one from the other only by a serial number for example.

By "the images revealed each comprising a certain proportion of each interlaced image" is meant that the revealing raster unveils a certain proportion of each of the interlaced images of the combined image to form the revealed image. For each revealed image, the proportion of an interlaced image lies between 0 and 1, the value 0 being allocated to an interlaced image when the latter is not a component of the revealed image, that is to say when the latter is totally occulted by the revealing raster at the level of the corresponding block and the value 1 being allocated when the entirety of the interlaced image is a component of the revealed image, that is to say when the latter is not occulted at all by the revealing raster.

Micropatterns

All the elements of all the interlaced images and/or of the revealing raster may be composed of one or more micropatterns. This makes it possible to strengthen the security of the secure item, the micropattern being for example observed with the aid of a magnifying glass and constituting a level 2 security.

The micropatterns may each be a number, a text, one or more alphanumeric signs, one or more ideograms, represent an object, a person, an animal, a monument, preferably be a number, a text, an alphanumeric sign or one or more ideograms.

The element or elements of interlaced images and/or of the revealing raster may each be composed of several micropatterns, especially of a micropattern repeating periodically in one or more directions over the whole dimension of the element in this or these directions.

The micropatterns of an element may form a line appearing continuous, especially when observed with the naked eye at a normal observation distance.

By "normal observation distance" is meant the customary distance of observation of a secure item, for example 30 cm and preferably 15 cm.

Advantageously, all the elements of one and the same interlaced image are composed of the same micropattern, especially of a micropattern repeating periodically in one or more directions over the whole dimension of the elements in this or these directions.

The micropatterns exhibit at least one dimension of less than or equal to 1 mm, better less than or equal to 100 μm, better still less than or equal to 50 μm. In view of their dimensions, the micropatterns are not apprehendable to the naked eye and the interlaced-image elements and/or raster elements appear homogeneous. For example, the color of the elements of interlaced images and/or of the revealing raster depends on the color of the micropatterns of which they are composed. Red-colored micropatterns form red-colored elements which appear uniform.

Preferably, the micropatterns are of different colors, so that the elements belonging to different interlaced images are of different colors, each of the elements having for example the color of the micropatterns of which it is composed. There is for example a colorimetric difference ΔE*94 according to C.I.E. 1994 of greater than or equal to 2, preferably greater than or equal to 3.

As is commonly admitted and specified in C.I.E. 1994, the color is defined by the combination of three parameters, namely hue, saturation and luminosity. Hue corresponds to the perception of the color measured on a chromatic disk, saturation corresponds to the purity of the color and luminosity corresponds to the degree of clarification or of darkening of a color.

Preferably, the micropatterns are of different hues, so that the elements belonging to different interlaced images are of different hues, each of the elements having for example the hue of the micropatterns of which it is composed.

The micropatterns belonging to different interlaced images may be different through their aspects, especially their shapes, and/or their hues, opacities, saturations, luminescences or brightnesses, and/or exhibit a contrast, especially a contrast of saturation, of intensity, of hue and/or of luminance, and/or a sufficient colorimetric difference to make it possible to distinguish, especially under white light, two adjacent interlaced-image elements when they are observed with a certain enlargement, for example with a magnifying glass. There is for example a colorimetric difference ΔE*94 according to C.I.E. 1994 of greater than or equal to 2, preferably greater than or equal to 3.

The colors of the micropatterns may or may not be primary colors.

The micropatterns may be fluorescent and exhibit different aspects, especially colors, under UV light.

The micropatterns may be luminescent.

The micropatterns may be represented in positive or in negative.

Each interlaced-image element and/or revealing raster element may comprise a background on which the micropattern or micropatterns is produced.

For example, the interlaced-image elements and/or raster elements are lines and the interlaced-image lines and/or raster lines are each composed of a micropattern repeating periodically over the whole of their length.

Preferably, the micropatterns are substantially the same width l as the line of interlaced images and/or raster line composed of them, especially a width l of less than or equal to 1 mm, better less than or equal to 100 μm, better still less than or equal to 50 μm.

Combined Image

Preferably, the combined image comprises a periodic alternation of elements of images interlaced in one or more directions.

The combined image may comprise at least two interlaced images, preferably at least three.

The combined image may comprise at least elements of each interlaced image, preferably at least three.

According to the or each of the directions, the successive elements of one and the same interlaced image may be mutually spaced by a distance defining a period.

The or each period may lie between 10 μm and 1 mm, preferably between 50 μm and 200 μm.

The elements belonging to different interlaced images, especially to at least two of the different interlaced images, may be different by their aspects, especially their hues, opacities, saturations, luminescences or brightnesses, and/or exhibit a contrast, especially a contrast of saturation, of intensity, of hue and/or of luminance, and/or a sufficient colorimetric disparity to make it possible to distinguish, especially under white light, two adjacent interlaced-image elements when they are observed with a certain enlargement for example with the aid of a magnifying glass. Thus, at least two of the, better all the interlaced images, are of different aspects.

Preferably, the elements of interlaced images belonging to different interlaced images are of different colors. There is for example a colorimetric disparity ΔE*94 according to C.I.E. 1994 of greater than or equal to 2, preferably greater than or equal to 3. This makes it possible to have a polychrome combined image.

Preferably, the elements of interlaced images belonging to different interlaced images are of different hues.

The interlaced-image elements of one and the same interlaced image appear, preferably, of the same color but of a different color from those of the other interlaced images. When superposing the revealing raster with the combined image, under given observation conditions, the image revealed by the revealing raster may then be an image whose color is defined by the proportion of each interlaced image that is visible, that is to say the proportion of each color. The images revealed by the revealing raster are of different colors. For example, the combined image comprises three interlaced images of respective colors red, green and blue and the revealed images are each of a color dependent on their proportion in each of the interlaced images, the color being easily determinable by its RGB coordinates. The RGB coordinates take the form of three numbers lying between 0 and 255 characterizing said color, each number representing the proportion of one of the components red, green and blue making it possible to obtain said color.

By "under given observation conditions" is meant a given position and a given orientation of the revealing raster with respect to the combined image and a given angle of observation of the revealing raster and of the combined image.

Preferably, the combined image, and the interlaced images that it comprises, are rasterized images; the combined image may be a colored raster.

The elements of interlaced images may be luminescent, in particular fluorescent and exhibit aspects, especially colors, that differ under UV light. This makes it possible to have revealed images observable under UV light that may or may not differ from the revealed images observable in visible light.

When the elements of interlaced images are luminescent, they may or may not be visible in white light.

The elements of interlaced images are preferentially all of e same dimension in the or each of the directions.

The dimension of the elements of interlaced images in the or one of the directions is, preferably, equal to the period in this direction divided by the number of interlaced images. This dimension may be less than or equal to 1 mm, better less than or equal to 100 μm, better still less than or equal to 50 μm. Thus, the elements of interlaced images are adjoining. Each interlaced-image element may be partially superposed with one of the adjacent elements, the superposition width being less than or equal to 10%, better 5% of the dimension of the interlaced image element in said direction.

As a variant, at least two elements of interlaced images may be of different dimensions in the or one of the directions.

The elements of interlaced images have, preferably, the same general shape.

For example, the combined image comprises a periodic alternation of interlaced image lines, of longitudinal axes which are mutually parallel in one direction. The longitudinal axes of the interlaced image lines define a general orientation of the combined image.

Each interlaced image may be formed of continuous or discontinuous lines, preferably continuous, two successive lines of the same interlaced image being spaced apart by a distance S defined between the longitudinal axes of the two adjacent lines, this latter defining the period of the combined image. The lines of one and the same interlaced image may or may not all be identical.

The lines of an interlaced image are, preferably, all of the same length. But it may be otherwise, and at least two interlaced image lines may be of different lengths.

Each line of an interlaced image is preferentially of constant width/over the whole of its length, its longitudinal edges being mutually parallel.

The interlaced image lines are, preferably, all of the same width.

The width l of the interlaced image lines is, preferably, equal to the period divided by the number of interlaced images. Thus, the interlaced image lines are adjoining. The width l of the interlaced image lines may be less than or equal to 1 mm, better less than or equal to 100 μm, better still less than or equal to 50 μm.

Each line of interlaced images may be partially superposed with one of the adjacent lines, the width of the superposition being less than or equal to 10%, better 5% of the width of said line of interlaced images.

As a variant, at least two lines belonging to different interlaced images are of different widths.

The interlaced image lines have, preferably, the same general shape, stated otherwise, the edges of the interlaced image lines are mutually parallel. The interlaced image lines may be rectilinear, or not, for example curved, undulated or crenellated.

As a variant, the interlaced images may each be composed of elements, especially of lines, continuous or discontinuous, forming a macropattern and each revealed image may correspond to an interlaced image so that a displacement of the revealing raster with respect to the combined image and/or that a change of the angle of observation makes it possible to pass from one interlaced image to the other and therefore from one macropattern to the other. For example, the combined image corresponds to the decomposition of a motion especially of a text, of alphanumeric signs, of ideograms, of an object, of a person and/or of an animal, each pattern corresponding to a step of the motion.

The combined image may exhibit a resolution of greater than or equal to 800 dpi, better still greater than or equal to 1000 dpi. Stated otherwise, it requires for its production other means of printing or of manufacture capable of producing details corresponding to such a resolution. With such a resolution, the micropatterns are not visible with the naked eye at a normal observation distance and the interlaced-image elements appear as homogeneous elements. This strengthens the anti-copy and anti-forgery security of the item.

The combined image may be as such, that is to say on being observed directly without involving the revealing raster, of substantially homogeneous aspect to the naked eye and at a normal observation distance having regard to its fineness. For example, the combined image may appear to the naked eye and at a normal observation distance as having a uniform aspect in regions of its surface of macrometric dimension, especially a uniform color over the whole of its surface. This makes it possible if so desired, to have revealed images which exhibit a homogeneous aspect to the naked eye and at a normal observation distance.

In the case of interlaced images of various colors, the combined image and the revealing raster may be disposed in such a way that the revealed images each appear of solid color.

The combined image may exhibit any suitable contour, and especially its contour may define a pattern which is situated elsewhere on the item; the combined image is for example of contour defining a pattern such as a person, animal, plant, monument or alphanumeric sign, which appears elsewhere on the item, for example in the form of a printing or of a watermark.

Revealing Raster

Preferably, the revealing raster comprises a periodic alternation of two raster elements in one or more directions otherwise known as orientations.

Preferably, the revealing raster comprises at east four raster elements, more preferentially at least six.

As a variant the revealing raster comprises a periodic alternation of at least three raster elements. In particular a revealing raster comprising a periodic alternation of an infinity of raster elements forms a periodic gradation.

The raster elements are, preferably, of different opacities, transparencies and/or hues, in particular one raster element is occulting, especially appears opaque and the other element is non-occulting, for example appears non-opaque. For example, the revealing raster is formed of a periodic alternation of occulting elements, for example black substantially opaque and of non-occulting elements, for example transparent, otherwise called line spacings. Therefore, when the revealing raster and the combined image are superposed, the occulting elements prevent the observation of a part of the combined image and the non-occulting elements unveil the remainder of the combined image.

As a variant, the occulting raster element is a filter which is such that when it is superposed with the combined image, the combined-image parts with which it is superposed are not visible. For example, the revealing raster is a colored filter not allowing through any of the colors of the combined image.

Preferably, the raster elements have the same form as the interlaced-image elements. That is to say that if the interlaced-image elements are in the form of lines, the raster elements take the form of lines.

The occulting raster elements may be composed of micropatterns.

Advantageously, when the revealing raster and the combined image are superposed, the raster and the combined image have the same orientation or the same orientations. In particular, the directions in which the raster elements alternate periodically and the directions in which the interlaced-image elements alternate periodically are identical. Therefore, when the revealing raster and the combined image are superposed, the raster elements are superposed with the interlaced-image elements of the combined image; the occulting raster elements prevent the observation of a part of the interlaced-image elements of the combined image, and the other interlaced-image elements form the revealed images.

For one and the same dimension in a direction of the elements of interlaced images, a revealing raster exhibiting occulting raster elements of small dimension makes it possible to observe a revealed image comprising a larger proportion of interlaced images, especially of colors, than a revealed image observed with a revealing raster or a raster block exhibiting occulting raster elements of larger dimension.

The revealing raster comprises occulting raster elements and non-occulting raster elements.

The occulting elements afford a visual contrast with the non-occulting elements. The boundary between an occulting element and a non-occulting element is thus determined by the fact of being able or not being able to observe the effect sought, by superposition with the combined image.

This observation may be done through the non-occulting elements. As a variant, the combined image is situated between the revealing raster and the observer, and the occulting elements prevent the observer from discerning the occulting elements of the interlaced image which are superposed with it. In examples, the non-occulting element is perfectly transparent or of a sufficiently low uniform opacity or else of a sufficiently bright hue to make it possible to observe through it or on it the element or elements of interlaced images leading to the effect sought. In this case, the dimension in a direction of the non-occulting element corresponds to the width in this direction of the perfectly transparent region or region of sufficiently low uniform opacity or of sufficiently bright hue. In these examples, the transition between an occulting element and a non-occulting element is stark. In other examples, the occulting element and/or the non-occulting element forms(form) a gradation. In this case the limit of the non-occulting element in a direction, useful for determining its dimension in this direction, is that on the basis of which the opacity is sufficiently high or the hue sufficiently dark to avoid seeing the effect sought through or on the element. For example, in the case where the transition between an occulting element and a non-occulting element occurs with a continuous gradation of gray of opacity varying in a direction between $Op_{min}$ and $Op_{max}$ and when, beyond an opacity $Op_{occ}$, it is no longer possible to see the effect sought through the element, the dimension of the non-occulting element is given by the dimension in this direction of the region of the element where the opacity is less than or equal to $Op_{occ}$.

Preferably, the revealing raster comprises a finite number of raster elements. Preferably still, the raster elements do not exhibit any gradation.

Preferably still, the non-occulting elements are each of uniform opacity or luminosity (L* in the CIE94 (L*, a*, b*) system), which may be zero, respectively low, and the occulting elements are also preferably of uniform opacity or luminosity.

Preferably, the period in a direction is substantially equal to the period of the combined image in one of its directions.

The revealing raster may comprise at least 5 occulting raster elements in the or each of its directions.

For example, the revealing raster comprises a periodic alternation of two raster lines of mutually parallel longitudinal axes.

Preferably, the two raster lines have parallel longitudinal axes and define a general orientation of the revealing raster.

Preferably, each raster line is of constant width over the whole of its length, its longitudinal edges being mutually parallel. The occulting raster lines and the non-occulting raster lines which alternate with one another may or may not be of the same width.

Preferably, the two raster lines have the same general shape as the interlaced image lines.

The two raster lines are, preferably, rectilinear, but as a variant the revealing raster comprises raster lines which are not rectilinear, being for example curved, undulated or crenellated.

Preferably, the edges of one of the raster lines are parallel to the edges of the other of the raster lines.

The resolution of the revealing raster is, preferably, greater than or equal to 800 dpi, more preferentially greater than 1000 dpi.

The revealing raster may be as such of homogeneous aspect to the naked eye and at a normal observation distance, having regard to its fineness. In particular, the revealing raster may appear observed with the naked eye at a normal observation distance and in white light as having a uniform aspect, especially color.

The revealing raster may exhibit a contour of any shape, for example circular, oval, disk section, star, polygonal, for example rectangular, square, triangular, hexagonal, pentagonal or lozenge-shaped, or form a more complex pattern, especially a pattern representing a text, an alphanumeric sign, an ideogram, an object, a person, a plant, a monument and/or an animal.

The revealing raster may comprise an inclusion of another security means, especially of another revealing raster.

The revealed images are observable in reflected light and/or in transmitted light, and preferably they are observable at one and the same time in reflected light and in transmitted light.

Advantageously, the revealed images exhibit a homogeneous aspect to the naked eye and at a normal observation distance, especially a homogeneous color.

The revealed images are, preferably, observable at one and the same time on the revealing raster side and on the combined image side.

Preferably, the revealed images exhibit different aspects, especially different colors and/or brightnesses.

The revealed image may consist of at least two, preferably at least three adjacent interlaced images.

As a variant, the revealed image may comprise a single interlaced image.

Preferably, the revealed image forms a macropattern when the revealing raster is superposed with the combined image, under given observation conditions. Preferably, this macropattern is visible when the orientation of the revealing raster is the same as that of the combined image.

Preferably, the revealed images form macropatterns exhibiting different aspects, especially different colors and/or brightnesses, for example having different RGB coordinates and/or different patterns, these patterns correspond for example to the various steps of a motion.

The macropattern may change aspect upon a displacement in the direction or one of the directions of the combined image, and/or a change of the angle of observation. For example, in the case of a combined image formed of interlaced images of various colors, the pattern may change color. This change of aspect may give an impression of motion. In the case of interlaced images corresponding to the decomposition of a motion, the macropattern may change so as to yield an impression of motion.

The macropattern may disappear upon a change of the orientation of the revealing raster with respect to that of the combined image, especially when the orientation of the raster becomes different from that of the combined image.

The macropattern formed may be of any form, especially represent a text, an alphanumeric sign, an ideogram, a geometric shape, an object, a person and/or an animal.

The secure item or the assembly may comprise a second revealing raster separated from the first revealing raster and intended to be superposed with the same combined image.

As a variant, the combined image may be formed of a periodic alternation of pixels of interlaced images in two non-parallel directions.

By "pixels" is meant an elementary pattern. A pixel may be of polygonal shape, especially triangle, hexagon, rectangle or square.

The revealing raster may be formed of a periodic alternation of occulting raster pixels in the same two directions and with the same periods in the two directions. Thus, the occulting raster pixels prevent the observation of a part of the pixels of interlaced images unveiling only a certain proportion of each interlaced image for each revealed image.

As a variant, when the combined image is formed of a periodic alternation of pixels of interlaced images in two non-parallel directions, the associated revealing raster or each associated raster block may be simplified by defining a periodic alternation of occulting raster elements and of non-occulting raster elements in the form of lines.

Observation

The combined image and/or the revealing raster may be carried on the secure item or the other object by a printing method, especially offset, copper-plate, laser, heliogravure, typography or silk-screen printing, the combined image and/or the revealing raster being printed with opaque, fluorescent, translucent and/or transparent, colored or non-colored inks, visible with the naked eye, under ultraviolet (II) and/or infrared (IR) light.

The combined image may be printed especially by a combination of colors exhibiting sufficient respective colorimetric disparities, for example printing with CMYB (Cyan, Magenta, Yellow, Black) and preferably with RGB (Red, Green, Blue).

Advantageously, metallizations and/or demetallizations are used to avoid forgery by printing.

Thus, the combined image and/or the revealing raster may comprise metallizations and/or demetallizations, for example of different metals, especially copper or aluminum and their alloys.

The combined image and/or the revealing raster may further be printed with liquid crystals and be carried on a region of the secure item which is light-polarizing, in such a way that the combined image and/or the revealing raster are visible only upon folding the item on itself or through an external polarizer.

The at least one of the combined image and of the revealing raster may feature on an at least partially transparent region of the secure item, the superposition of the revealing raster and of the combined image being performed by folding the secure item or by superposing the secure item with the other object. The revealing raster may make it possible, when superposed at least partially with the combined image of the secure item or of the other object, to observe different revealed images by a relative displacement of the revealing raster with respect to the combined image depending on the direction or one of the directions of the combined image and of the revealing raster.

The folding of the secure item may be done along a mid-line of the item, preferably parallel to a side of the item, for example along a mid-line passing through the middle of the length of the item.

The revealing raster and the combined image may be superposed while being separated from one another by a gap of constant thickness. This gap may be formed by a transparent or translucent substrate exhibiting on the side of a first face of the substrate the combined image and on the side of a second face of the substrate, opposite to the first face, the revealing raster superposed with the combined image. The revealing raster may then make it possible to observe different revealed images, through a parallax effect, upon a change of the direction of observation of the secure item. The gap between the revealing raster and the combined image is, preferably, greater than or equal to the period of the revealing raster, especially lying between 10 μm and 1 mm, being for example less than 25 μm.

In this case, the revealing raster may make it possible to observe different revealed images upon a change of the direction of observation of the secure item.

The substrate may comprise or consist of a thermoplastic substance, for example a polyolefin, for example polyethylene (PE), polyvinyl chloride (PVC), polyester, polyethylene terephthalate (PET), polycarbonate (PC), polyester carbonate (PEC), polyethylene terephthalate glycol (PETG), acrylonitrile butadiene styrene (ABS) or a light-collecting film for example of the "waveguide" type, for example a luminescent film based on polycarbonate marketed by the company BAYER under the name LISA®.

The substrate may comprise cellulose fibers and especially paper. In particular, the substrate may be a paper which is sufficiently translucent to make it possible to reveal the interlaced images, especially a tracing paper.

The substrate may or may not also be locally transparentized, by watermarking such as described in patent EP 1252389 or by applying a generally fatty composition which transparentizes it in a permanent manner, for example a composition made of oil and of transparent mineral material, as described in patent U.S. Pat. No. 2,021,141, or for example a composition in the form of a wax combined with a solvent.

It is also possible to transparentize the substrate by locally applying a wax by hot transfer, as described in patent U.S. Pat. No. 5,118,526.

It is further possible to use for the substrate a fibrous layer comprising a thermofusible substance, for example polyethylene, as described in patent EP 0 203 499, which under the local action of heat will have its transparency varied.

Secure Item

The secure item may be at least partially made of paper or plastic, in particular may comprise a rolled or extruded plastic sheet.

The secure item may comprise at least one ply of paper, especially based on natural and/or synthetic fibers, for example cotton or linen fibers in the case of a banknote.

The secure item may be at least partially transparent, opaque or translucent, especially opaque in reflected light and translucent in transmitted light.

The combined image and/or the revealing raster may be carried by a film, a lamination band, a patch and/or a foil featuring on the secure item. The film, the lamination band, the patch and/or the foil may comprise metallizations and/or demetallizations, for example of aluminum or copper, or all types of printings.

By "patch" is meant an element of smaller dimensions than that of the secure item and which might not extend as far as the edge of the item. The patch may exhibit a polygonal, circular, oval contour or one forming a more complex pattern, especially a pattern representing a text, an alphanumeric sign, an ideogram, an object, a person, a plant, a monument and/or an animal.

By "foil" or "lamination band" is meant an element applied, in particular hot, for example by transfer onto the secure item in particular from a carrier structure.

The film, the lamination band, the patch and/or the foil may comprise holographic prints and/or liquid crystals.

The combined image and/or the revealing raster may further be carried by a security thread, incorporated at the surface, bulk-wise or preferably as window(s) in the secure item.

The combined image and/or the revealing raster may be incorporated window-fashion in the secure item.

The window may be formed on the secure item during its manufacture.

The window may be formed by a material void, for example the local absence of paper, above or below the combined image and/or the revealing raster, the window preferably being at least partially transparent or translucent on the side of the combined image and/or of the revealing raster opposite to the material void.

The window may also not comprise any material void. The window may for example be at least partially transparent or translucent above or below the combined image and/or the revealing raster, the transparent or translucent regions being superposed one with the other in such a way as to be able to observe the two opposite sides of the secure item.

The window may also be a through-window. The window may exhibit superposed material voids on either side of the revealing raster and/or of the combined image. Two sides of the combined image and/or of the revealing raster may thus be observable directly and not through transparent or translucent regions. The revealing raster and/or the combined image may be incorporated totally in the window or partially.

The item may further exhibit a plurality of windows such as described hereinabove. The windows may or may not all be of the same type. Exemplary embodiments of windows in secure items are for example given in GB 1 552 853 which discloses the creation of a window especially by transparentization, laser cutting, mechanical incision or abrasion, EP 0 229 645 which describes the creation with the aid of masks of a window on one face or on both faces of a two-ply paper, WO 2004/096482 which describes the creation of a window by laser cutting, CA 2 471 379 which describes the creation of a transparent window and association with a security element and WO 2008/006983 which describes the creation of a transparent window on a two-ply paper.

The secure item may further comprise a security thread exhibiting the combined image and/or the revealing raster, especially a succession of combined images and/or of revealing rasters.

The secure item may further comprise two security threads, the one carrying at least one combined image and the other carrying at least one corresponding revealing raster. The security thread or threads may exhibit a sufficient width to enable the combined image and/or the revealing raster to be made to feature therein in full. The width of the security thread or threads is preferably to be between 3 and 20 mm, more preferentially between 4 and 10 mm and for example equal to 6 mm.

As indicated above, the revealing raster and/or the combined image advantageously feature on an at least partially transparent region of the item, in particular the revealing raster and/or the combined image may be at least partially transparent.

The at least partially transparent region may correspond to a recess, passing right through or not, of the item in which the revealing raster and/or the combined image is placed.

The region consists for example of a translucent tracing paper.

The region may further consist of a polymer layer comprising for example polyethylene (PE), polyvinyl chloride (PVC), polyethylene terephthalate (PET), polycarbonate (PC), polyester carbonate (PEC), polyethylene terephthalate glycol (PETG), acrylonitrile butadiene styrene (ABS) or a light-collecting film for example of the "waveguide" type, for example a luminescent film based on polycarbonate marketed by the company BAYER under the name LYSA®.

The secure item, as well as the elements that it comprises such as for example a security thread, a patch and/or a foil, may comprise one or more additional security elements such as defined hereinafter.

Among these additional security elements, some are detectable by eye, in daylight or in artificial light, without using a particular apparatus. These security elements comprise for example colored fibers or slivers, totally or partially metallized or printed threads. These security elements are termed first level.

Other types of security elements are detectable only with the aid of a relatively simple apparatus, such as a lamp emitting in the ultraviolet (UV) or the infrared (IR). These security elements comprise for example fibers, slivers, bands, threads or particles. These security elements may or may not be visible with the naked eye, being for example luminescent under a lighting of a Wood lamp emitting at a wavelength of 365 nm. These security elements are termed second level.

Other types of security elements further require for their detection a more sophisticated detection apparatus. These security elements are for example capable of generating a specific signal when they are subjected, simultaneously or not, to one or more sources of exterior excitation. The automatic detection of the signal makes it possible to authenticate, if relevant, the item. These security elements comprise for example tracers taking the form of active substances, of particles or of fibers, capable of generating a specific signal when these tracers are subjected to an optronic, electrical, magnetic or electromagnetic excitation. These security elements are termed third level.

The additional security elements present within the secure item may exhibit security characteristics of first, second or third level.

The secure item may be a payment means, such as a banknote, a check, a bank card or a restaurant voucher, an identity document such as an identity card or a visa or a passport or a driver's license, a lottery ticket, a secure card, a transport pass or else an entry ticket to cultural or sports shows.

Imager

As a variant, the other object is an electronic imager making it possible to form a first image, the first image being the revealing raster or the combined image, so as to be able to superpose it with a second image present on the secure item, the second image being the other of the revealing raster and of the combined image.

By "electronic imager" is meant an electronic device making it possible to produce an image by display or projection.

The electronic imager may comprise a screen on which the first image is displayed.

The electronic imager may comprise a screen of any known type, for example a screen of a computer, of a television, of a mobile telephone, of an electronic book or diary, of a personal digital assistant, of a digital tablet, of a watch dial, this list being nonlimiting.

The electronic imager may be a projector, with or without a screen on which the projection is performed. The projector may make it possible to project the first image onto a background or onto the security item.

The electronic imager may be a projector of any known type, for example a slide projector, a video projector, a backprojector, a picoprojector or nanoprojector, for example a miniaturized video projector integrated into a portable apparatus (PDA, mobile telephone, laptop computer, for example), a cinematographic projector, this list being nonlimiting.

The electronic imager preferably makes it possible to generate a pixellated image, each pixel of which is individually addressable, preferably with at least 256 gray levels or colors, and/or with a resolution of between 50 and 1000 dpi ("Dots Per Inch").

The electronic imager may be a projector projecting a visible, infrared (IR) and/or ultraviolet (UV) light.

The electronic imager may comprise a screen of the LCD ("Liquid Crystal Display"), LED ("Light Emitting Diode"), OLED ("Organic Light Emitting Diode"), laser, plasma, electrochromic, FED ("Field Emission Display"), SED ("Surface-conduction Electron-emitter Display"), LCOS ("Liquid Crystal On Silicon") type or else a cathode ray tube.

The electronic imager preferably comprises a liquid crystal screen (LCD).

The screen may exhibit a resolution of between 50 and 600 dpi, better between 100 and 300 dpi, for example equal to 160 dpi.

The second image may feature on a region of reduced opacity of the secure item. Such a region of reduced opacity may in particular correspond to a region of lesser thickness, to a region rendered transparent or to a region comprising at least one layer of a material of lesser opacity. The opacity of said region of reduced opacity will in particular be sufficiently low to allow observation in transmission of the first image. Preferably, the second image is visible in transmission and in reflection.

The second image may feature on an at least partially transparent or translucent region of the secure item.

When the electronic imager produces the first image by means of a polarized light, the second image features preferably on an at least partially transparent or translucent region, especially an at least partially transparent window.

The first image produced by the electronic imager may be displayed on the electronic imager, for example on a screen of the electronic imager.

As a variant, the first image is projected by the electronic imager, for example onto a background or onto the secure item. In particular, when the first image is projected onto a background, the second image of the secure item may be superposed with the first image projected onto the background. As a variant, the first image is at least partially projected on the second image of the secure item.

The item and the imager may or may not come into contact when the images are superposed.

The first image and/or the second image may exhibit polarization properties.

For example, the first image is produced by the electronic imager by means of polarized light, especially rectilinearly, circularly or elliptically polarized light. The electronic imager may comprise a screen emitting polarized light or may project polarized light.

The secure item may comprise a polarizing filter. In particular, the second image may be produced with the aid of a polarizing filter.

The second image may be produced according to at least one of the following steps:

- production of one or more perforations in at least one polarizing filter to form the second image,
- local heating of at least one polarizing filter, for example with the aid of a laser, so as to locally suppress the polarizing properties of the filter and to form the second image,
- selective application, for example by printing and/or gluing, to at least one polarizing filter, of a diffusing material, for example a colloidal silica and/or an adhesive band, to form the second image,
- carrying out of at least one selective attack by chemical reaction and/or by emission of luminous radiation, in particular ultraviolet (UV) and/or infrared (IR) and/or laser, on at least one polarizing filter, optionally with the aid of a mask, to form the second image, so as in particular to locally cancel the polarizing effect of the filter,
- application, in particular by printing or by coating, of at least one polarizing effect, in particular of a polarizing compound, for example with the aid of an ink comprising said polarizing compound, on a non-polarizing given substrate, in particular a polymer film, to form the second image,
- application, in particular by printing or by coating, of at least one composition comprising liquid crystals, cholesteric crystals in particular, for example such as that marketed by the company SICPA under the name Oasis®, to a polarizing given substrate, in particular a polymer film, to form the second image.

By way of remark, according to the desired effect, the above-stated steps will be carried out so as to form an image which is the image in positive or in negative of the second image. In particular, a polyether base aliphatic polyurethane, for example such as that marketed by the company LAMBERTI under the name Esacote® PU 21/S, can be applied locally to at least one polarizing filter, for example by printing.

In the last possibility mentioned hereinabove, when during the implementation of the method according to the invention, the composition comprising cholesteric liquid crystals is situated between the polarizing substrate and the electronic imager, the cholesteric liquid crystals modify the electronic imager's polarized light which is not stopped by the substrate and the regions covered with cholesteric liquid crystals appear transparent when the polarizing substrate is oriented in such a way as to be opaque.

On the other hand, when the polarizing substrate is situated between the composition comprising cholesteric liquid crystals and the electronic imager, the cholesteric liquid crystals exhibit an optically variable effect when the polarizing substrate is oriented in such a way as to be opaque. The optically variable effect of the cholesteric liquid crystals is more generally known by the term "colorshift" effect, the color of the cholesteric liquid crystals depending on the angle of observation and the latter being in particular observed on a dark background, preferably black in color. The "colorshift" effect of the cholesteric liquid crystals may constitute an additional security to authenticate and/or identify the secure item.

Thus, in particularly preferred exemplary implementations of the method according to the invention, the second image is defined by a first polarizing material superposed on a second polarizing material, the first material extending in particular according to patterns corresponding to the second image and the second material extending in a continuous manner. The first material is preferably a printing of cholesteric liquid crystals and the second material is preferably a linearly polarizing substrate.

By "patterns corresponding to the second image" is meant that said patterns form the second image in negative or in positive.

Advantageously, when the first and second images exhibit polarization properties, there exists only a single orientation of one with respect to the other allowing one to partially mask the other. Stated otherwise, there exists only a single orientation of the first image with respect to the second image making it possible not to be able to observe the first image through the polarizing regions of the second image, or vice versa. Indeed, the first and second images exhibiting polarization properties consist of polarizing regions and of non-polarizing regions. When they are placed in front of a luminous source emitting polarized light, there exists only a single orientation according to which the polarizing regions become opaque.

In particular, in the case where the item comprises a polarizing filter there exists for example only a single orientation of the second image with respect to the first image projected or displayed by the electronic imager by means of a polarized light, which allows the polarizing filter to mask the polarized light of the electronic imager. The polarizing filter may appear opaque, especially black in color, only in this, preferably unique, orientation of the first image with respect to the second image.

The presence of a unique orientation, such as described hereinabove, of the first and second images with respect to one another may make it possible to authenticate and/or to identify the secure item according to a first security level.

The electronic imager, for example the screen of the electronic imager, and/or the secure item, may comprise an indicator making it possible to advise the user on the way of positioning the first and second images with respect to one another to obtain said orientation, for example a visual reference marker.

According to a variant embodiment, the second image is printed with a compound, especially liquid crystals, which is visible only when placed in front of an electronic imager emitting polarized light, especially a liquid crystal screen. Advantageously, the second image is transparent under unpolarized illumination, for example under natural lighting, and is visible only under polarized illumination with the aid of the electronic imager, thereby affording the secure item an additional security.

The secure item may comprise an integrated microcircuit, for example an RFID chip or an optical chip (activated for example by the light issuing from the electronic imager), able to communicate with the electronic imager so that the latter produces, in particular displays and/or projects, a piece of information advising as regards the way of positioning the first and second images with respect to one another to obtain said orientation.

The secure item may comprise an integrated microcircuit, for example an RFID chip or an optical chip, able to communicate with the electronic imager so that the latter produces at least one first image whose association with the second image makes it possible to implement the method according to the invention. In particular, the electronic imager may produce at least one first image associated with a second image of the secure item by communication between the electronic imager and the integrated microcircuit.

The electronic imager may further produce at least one first image on the basis of a photo and/or of a video of the secure item, especially of the second image of the secure item or of an identifier present on the item, for example a logo or a serial number. The photo and/or video may be produced with the electronic imager, an image capture device, for example a digital camera, connected to the electronic imager by a wired or non-wired link and/or be transferred to the electronic imager, for example from a data storage device or via a network, such as the Internet.

The first image may be produced solely on the basis of the photo and/or video of the secure item, or as a variant, be produced on the basis of the photo and/or video of the secure item and of an additional piece of information, for example a piece of information present on the secure item, on the photo and/or video, input by the user, or else received from a network, for example of a secure server.

The electronic imager may comprise a program making it possible to identify the secure item, and especially the second image, and to produce, especially to display and/or to project, a first image obtained from a database advising as regards the first image to be used as a function of the secure item, especially of the second image.

The electronic imager may produce several first images and/or the secure item may comprise several second images, at least one of the first images making it possible to observe the authentication and/or identification piece of information when superposed with at least one of the second images according to the method of the invention, or vice versa.

In particular, it may thus be possible to authenticate and/or to identify the security item with various types of electronic imagers.

As a variant, a given electronic imager may make it possible to authenticate and/or to identify secure items of various types, comprising in particular different second images.

For example, the second images are differentiated by their size, their color, their shape, or indeed by the spacing between the raster elements or interlaced-image elements or the width of the latter.

The first images may also be differentiated by their size, their color, their shape, or indeed by the spacing between the raster elements or interlaced-image elements or the width of the latter, or else indeed by the size of the pixels, the spacing between the pixels or the color of the pixels.

The electronic imagers may for example be differentiated on account of their brand, their model, their resolution, their type, namely computer screen, television screen or telephone screen, or projector, for example.

The presence of several first images and/or second images may make it possible to authenticate and/or to identify the security item independently of the differences mentioned hereinabove.

The first image produced by the electronic imager may originate from a communication network with which the electronic imager communicates, for example a telephone network, Internet or an internal network, the image being for example downloaded, and/or be provided together with the electronic imager, for example on a data medium, for example a hard disk, a USB key, a CD and/or a DVD. The security item may, if relevant, comprise such a data medium. The data medium may be an integrated microcircuit, for example an RFID or optical chip, communicating with the electronic imager.

The secure item may comprise a luminescent region, for example fluorescent and/or phosphorescent, and the electronic imager may project the first image onto the secure item under ultraviolet (UV) lighting.

In particular, the second image may be a luminescent print, for example carried out on a black opaque background of the secure item, and onto which the first image is projected under UV lighting. The second image is then visible only under UV lighting.

The second image may further be printed on a luminescent background of the secure item, so that it is visible at one and the same time under UV lighting and normal lighting.

Method

A further subject of the invention is a method for authenticating a secure item according to the first and the second aspects of the invention, in which the image or images revealed by the revealing raster, one changes the angle of observation and/or the position of the revealing raster with respect to the combined image so as to observe a change of the revealed image and one concludes as to the authenticity of the item at least on the basis of this observation.

In the case where the combined image and the revealing raster or rasters are not superposed within the item, it is possible to superpose the revealing raster at least partially with the combined image so as to observe the images by folding the secure item and/or by superposing the secure item and the other object one changes the angle of observation and/or the position of the revealing raster with respect to the combined image so as to observe a change of the revealed image and one concludes as to the authenticity of the item at least on the basis of this observation.

When one of the revealing raster and of the combined image is formed by an electronic imager, the method may comprise at least one of the following steps:

- superposing at least partially the second image of the item with a first image formed by the electronic imager so as to make it possible to observe an authentication and/or identification piece of information in respect of the secure item,
- superposing at least partially the second image of the item with a first image produced by the electronic imager subsequent to a communication between the integrated microcircuit and the electronic imager,
- superposing at least partially the second image of the item with a first image produced by the electronic imager on the basis of a photo and/or video of the secure item, especially of the first image.

The photo and/or video may be produced with the electronic imager, an image capture device, for example a digital camera, connected to the object and/or be transferred to the electronic imager, for example from a data storage device or via a network, such as the Internet.

The invention will be able to be better understood on reading the detailed description which will follow, of non-limiting exemplary implementations of the latter, and on examining the appended drawing in which.

Figure 2A:
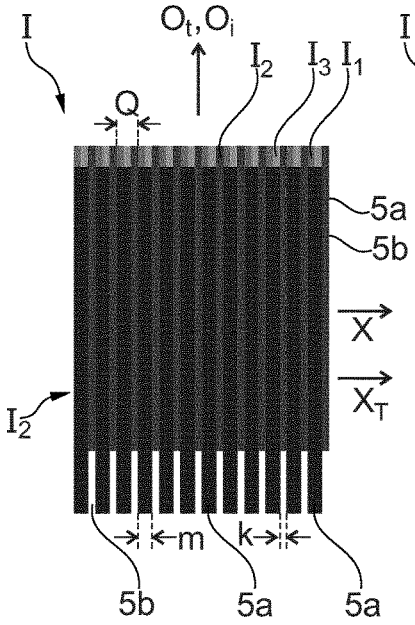
Figure 2B:
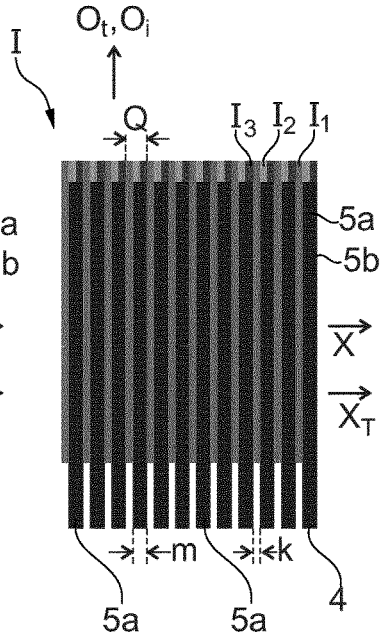
Figure 2C:
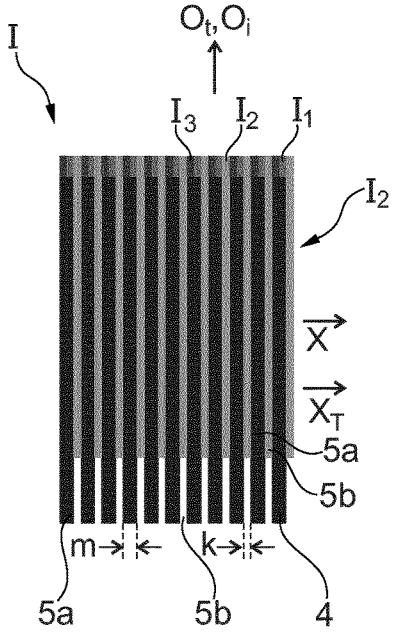
Figure 3A:
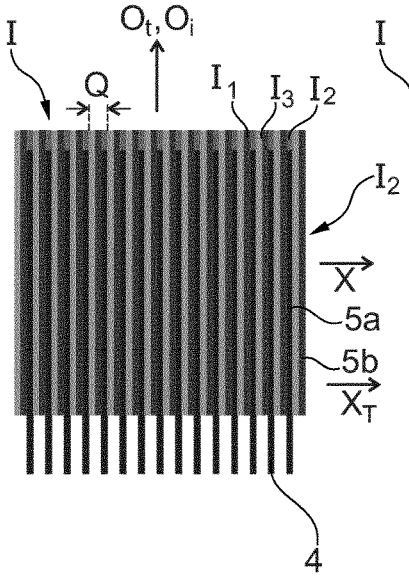
Figure 3B:
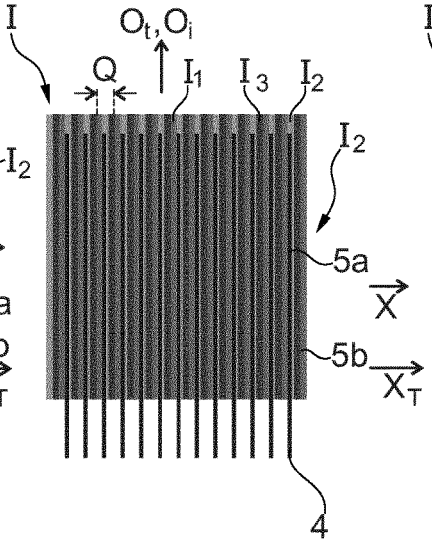
Figure 3C:
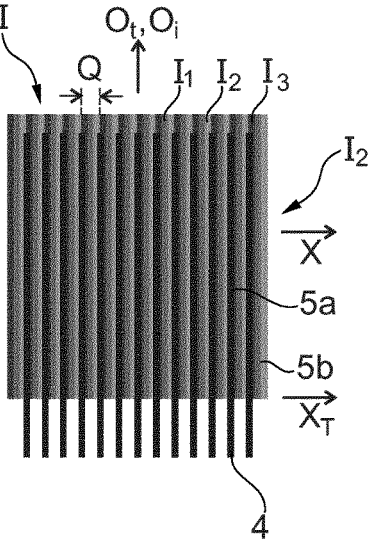
Figure 4:
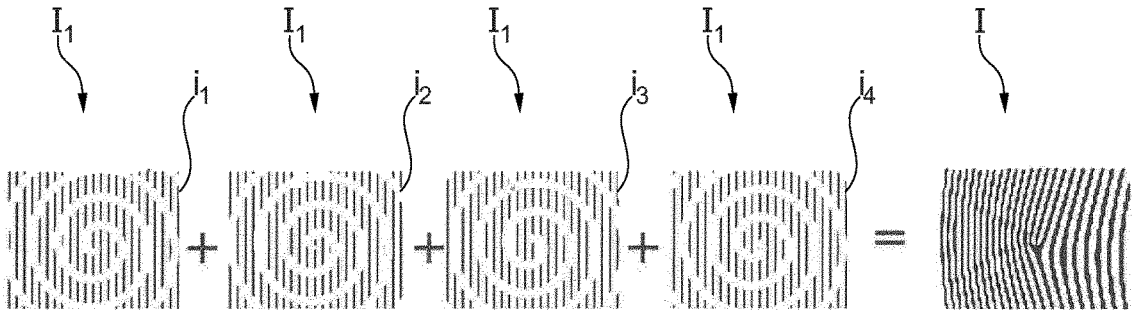
Figures 5A, 5B, 5C, 5D:
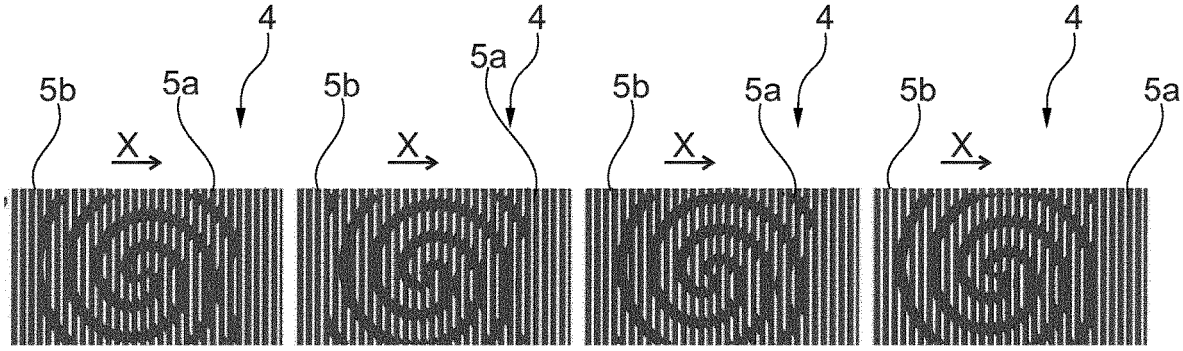
Figure 6:
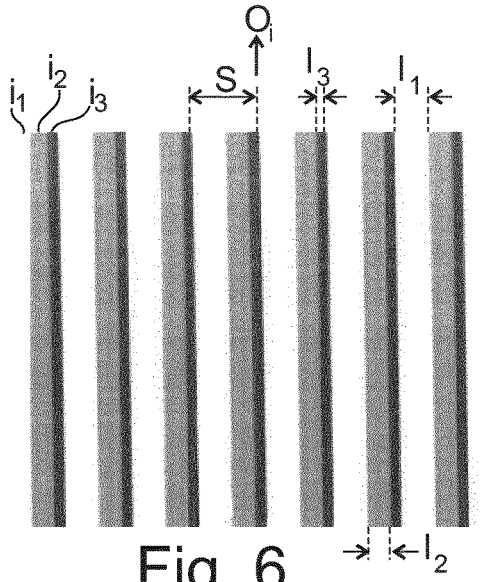
Figure 7A:
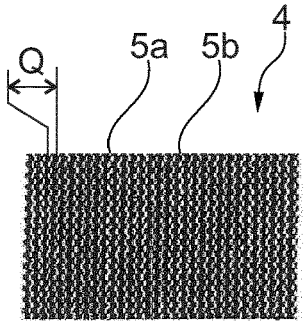
Figure 7B:
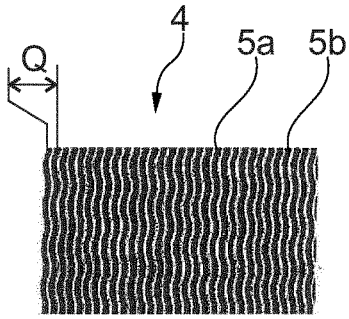
Figure 7C:
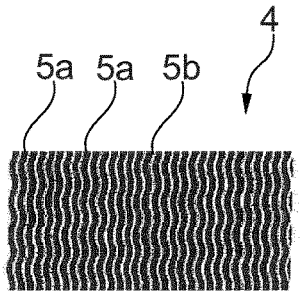
Figure 7D:
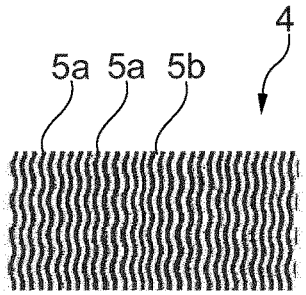
Figure 7E:
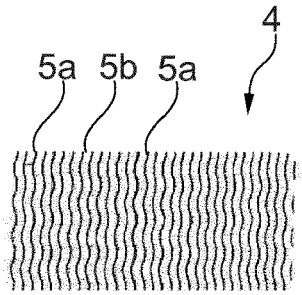
Figure 7F:
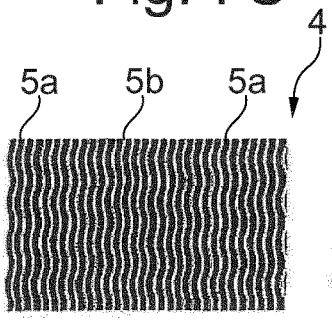
Figure 7G:
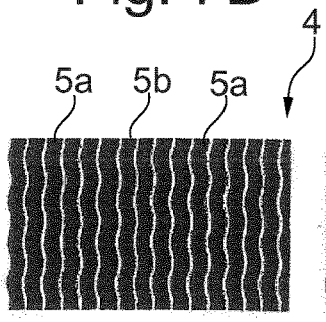
Figure 7H:
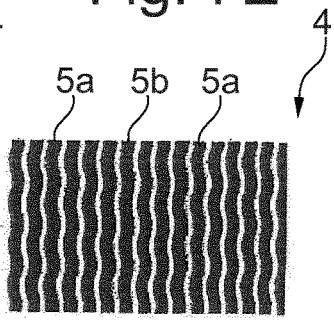
Figure 8:
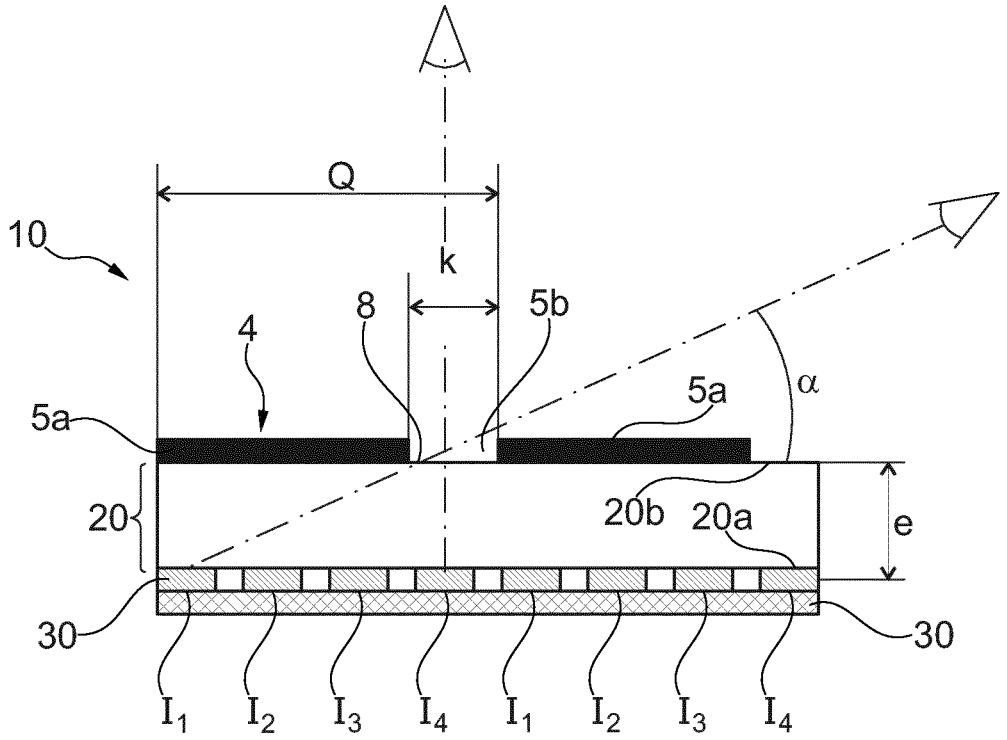

FIGS. 2A to 2C represent a succession of revealed images such as it may be observed when the observation conditions vary, FIGS. 3A to 3C represent a variant succession of revealed images such as it nay be observed when the observation conditions vary, FIG. 4 illustrates a variant combined image, FIGS. 5A to 5D represent a succession of revealed images such as they may be observed with the aid of the combined image of FIG. 4, when the observation conditions vary, FIG. 6 illustrates a variant combined image, FIGS. 7A to 7H represent variants of revealing rasters, FIG. 8 represents in cross-section, in a schematic and partial manner, an exemplary secure item produced in accordance with an exemplary implementation of the invention.

Figure 9:
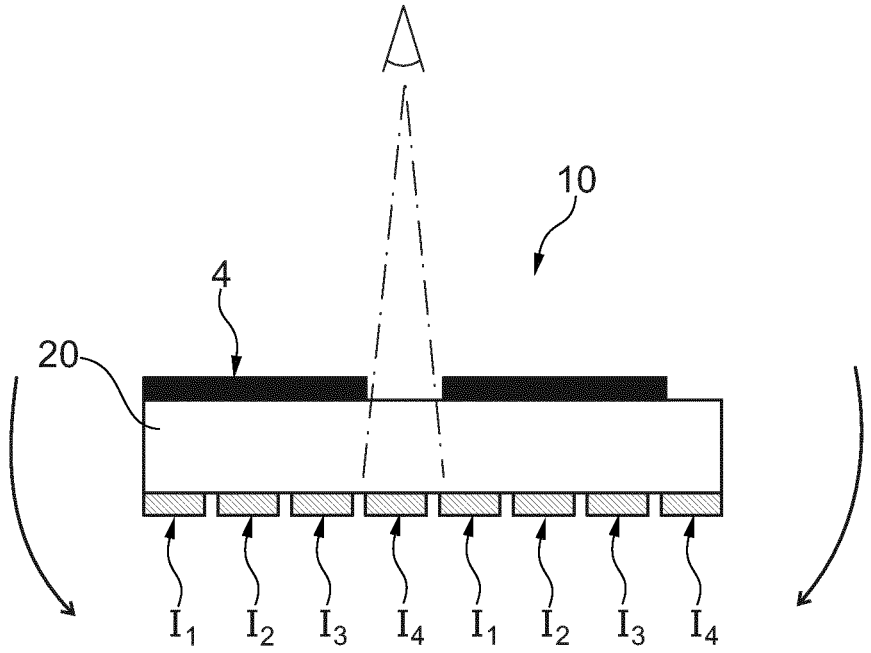
Figure 10:
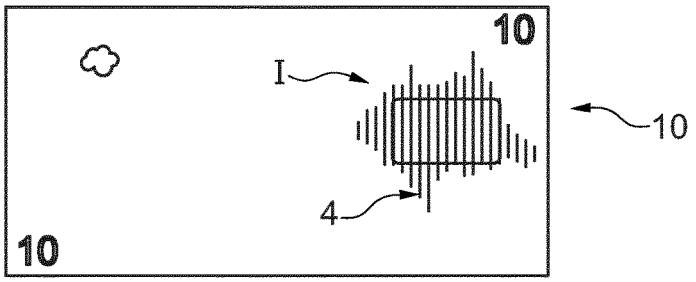
Figure 11:
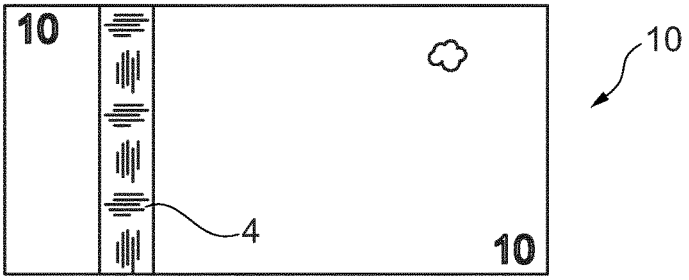
Figure 12A:
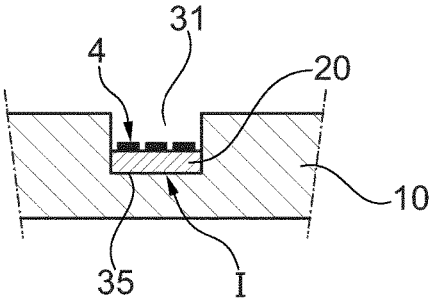
Figure 12B:
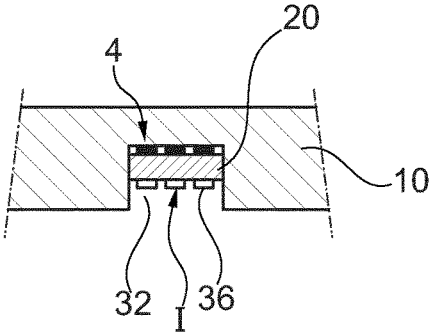
Figure 12C:
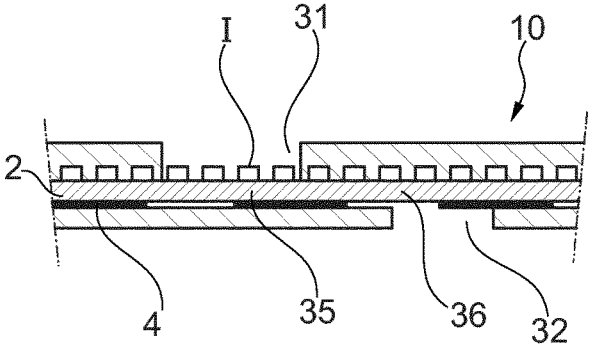
Figure 12D:
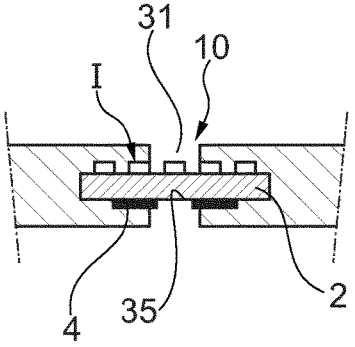
Figure 13:
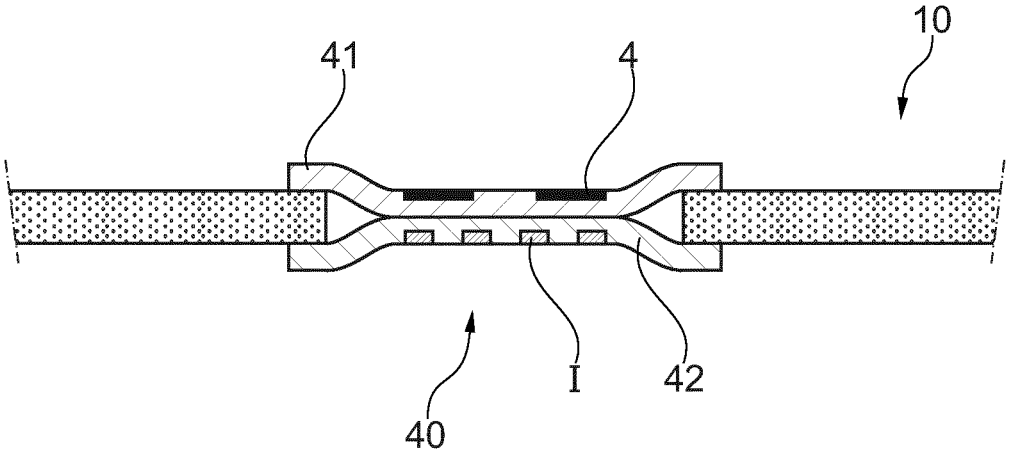
Figure 14:
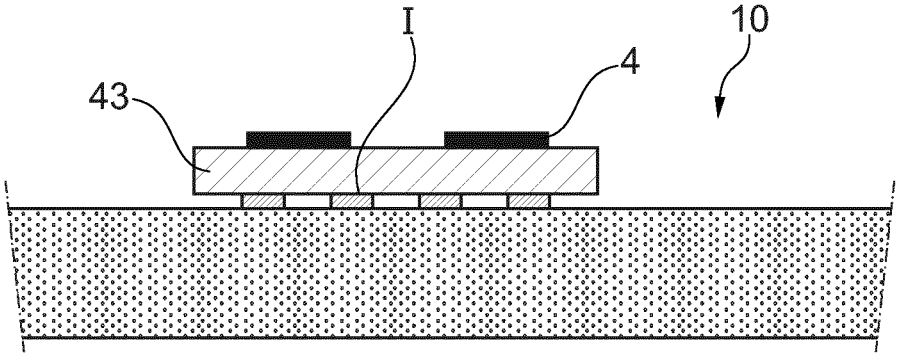
Figure 15:
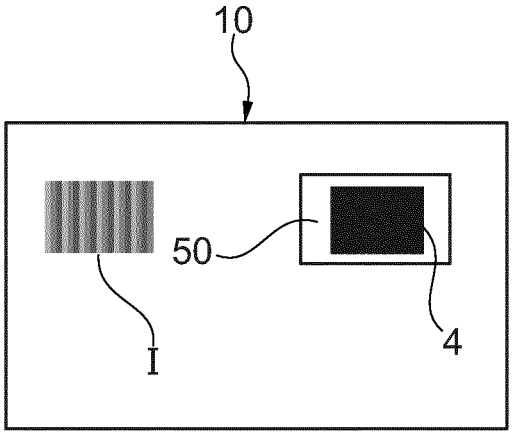
Figure 16:
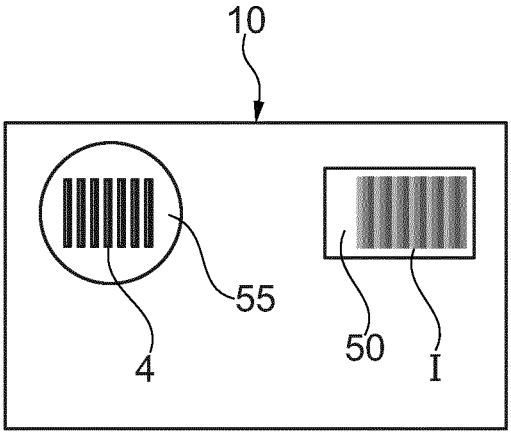

FIG. 9 illustrates the possibility of varying the inclination by deforming the secure item, FIGS. 10 and 11 represent two examples of secure items according to the invention, FIGS. 12A to 12D represent other examples of secure items according to the invention, in transverse section, in a schematic manner, FIGS. 13 and 14 illustrate variant embodiments of secure items according to the invention, in transverse section, in a schematic manner, FIGS. 15 and 16 represent exemplary embodiments of the secure item according to the invention, the combined image or the revealing raster being carried by a window of the item.

Figure 17:
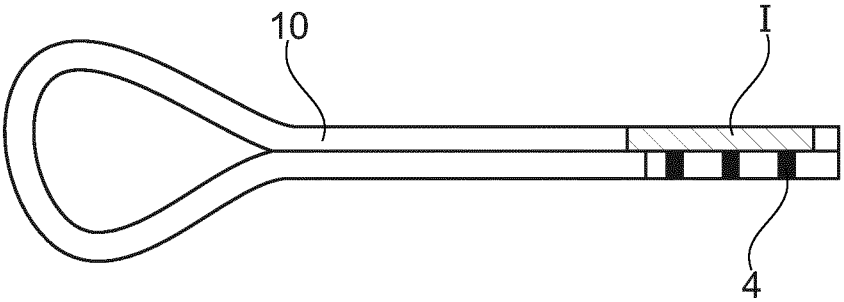
Figure 18:
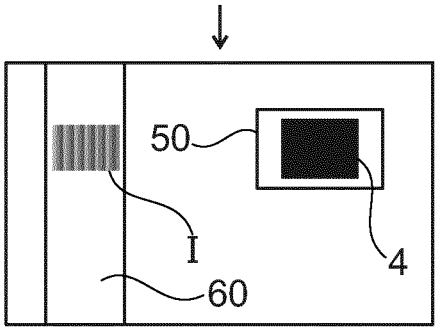
Figure 19:
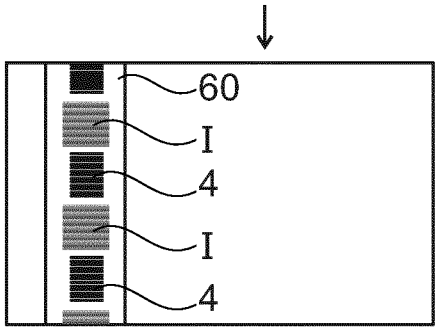

FIG. 17 represents the secure item folded,

FIGS. 18 and 19 represent exemplary embodiments of secure item according to the invention, the combined image or the revealing raster being carried by a security thread, FIGS. 20 to 23 represent other exemplary embodiments of secure items according to the invention, the combined image and/or the revealing raster being carried by at least one security thread or a foil.

Figure 24:
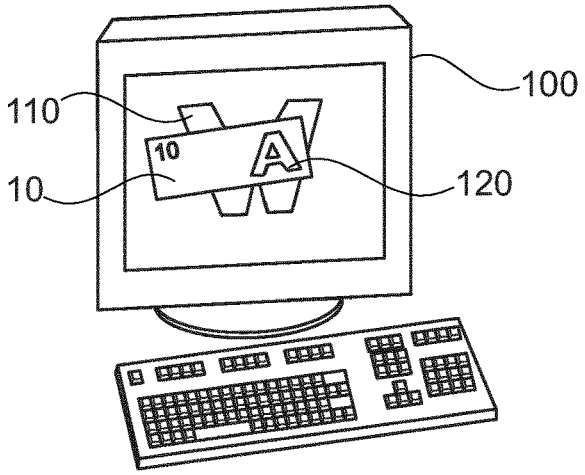
Figure 25:
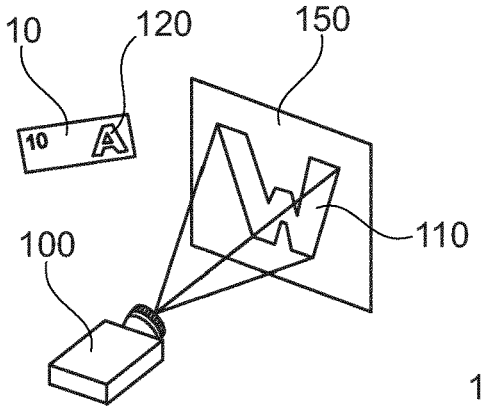
Figure 26:
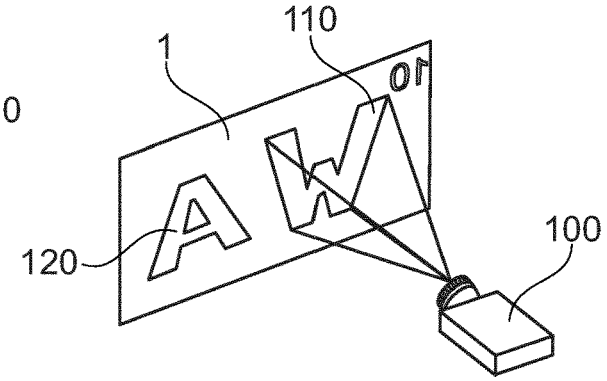
Figure 27:
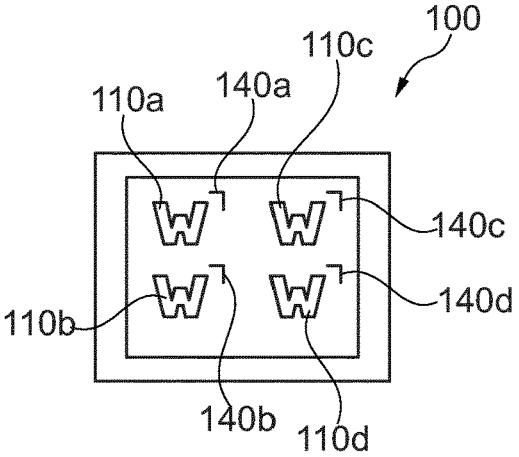
Figure 28:
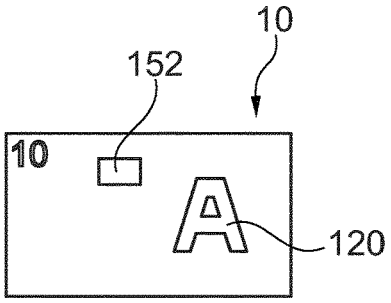
Figure 29:
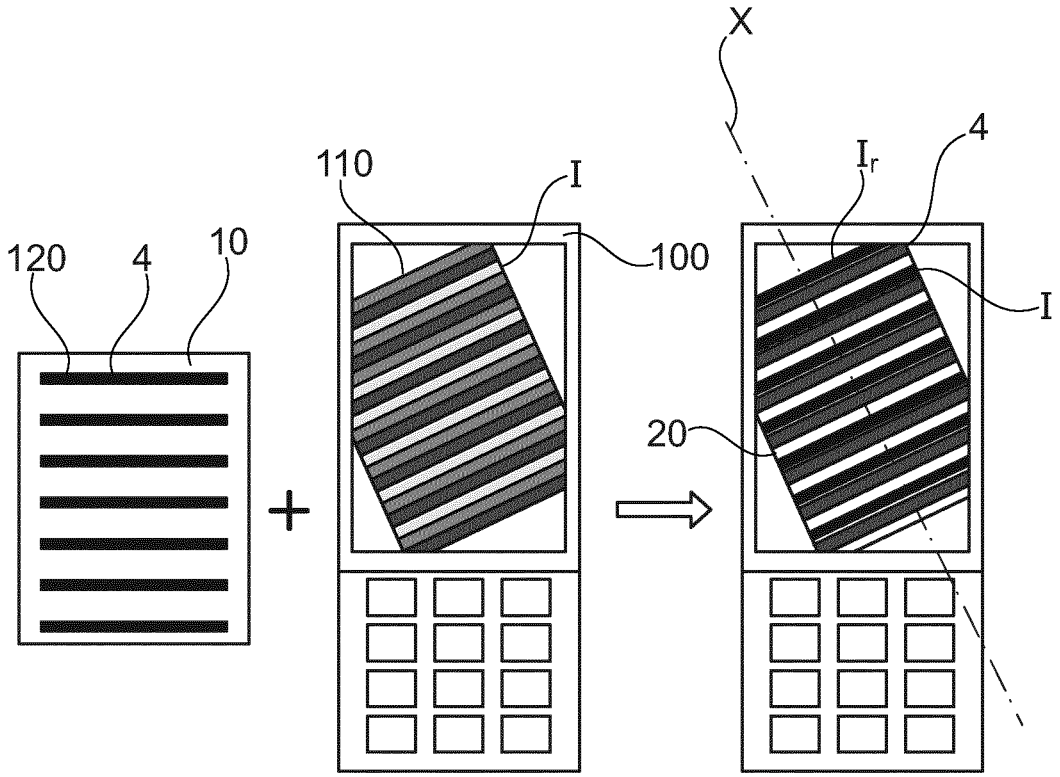
Figure 30A:
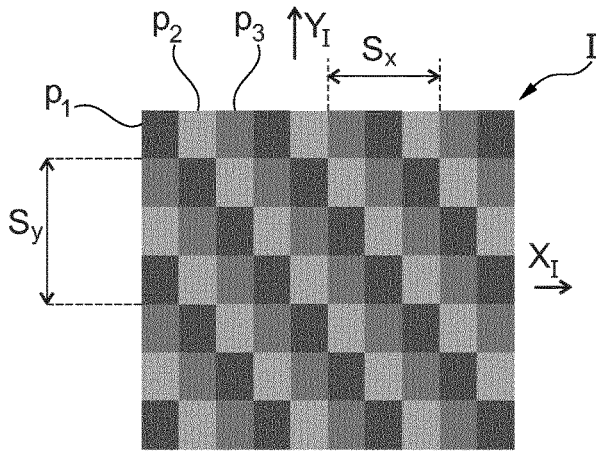
Figure 30B:
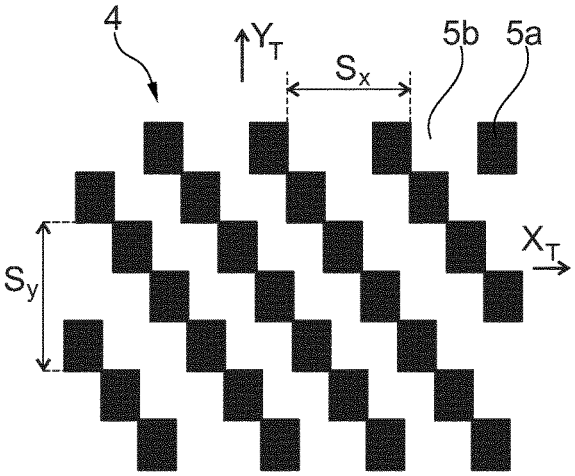
Figure 30C:
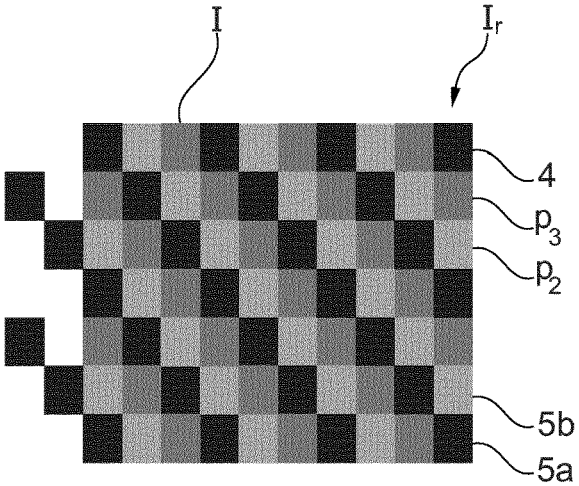
Figure 30D:
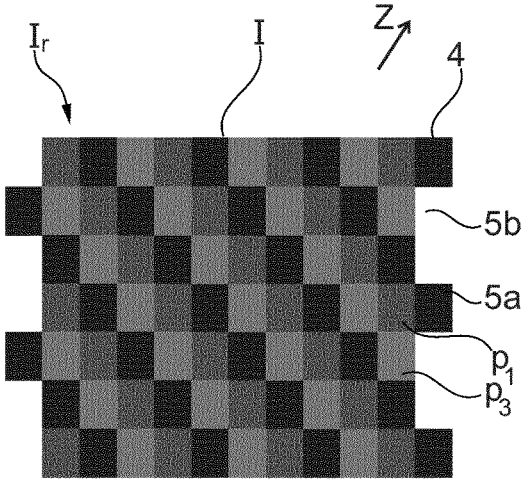
Figure 30E:
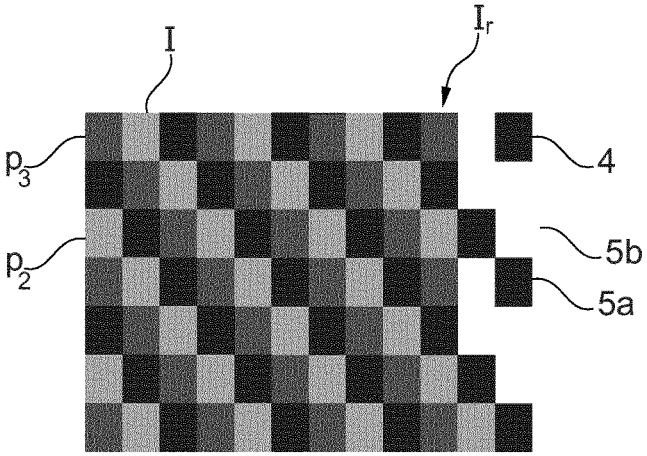

FIGS. 24 to 26 represent variant assemblies comprising an electronic imager and an item, FIG. 27 represents a variant of first images formed by an electronic imager, FIG. 28 represents a variant item comprising an integrated microcircuit, and FIG. 29 represents a variant assembly, the item comprising a second image in the form of a revealing raster and the electronic imager producing a first image in the form of a combined image, FIG. 30A represents another exemplary combined image, FIG. 30B represents a variant with a revealing raster in the form of pixels, and FIGS. 30C to 30E represent a succession of revealed images such as it may be observed with the aid of the combined image of FIG. 30A and revealing rasters of FIG. 30B when the observation angle varies and/or the relative position of the revealing raster and of the combined image varies.

COMBINED IMAGE

Figure 1A:
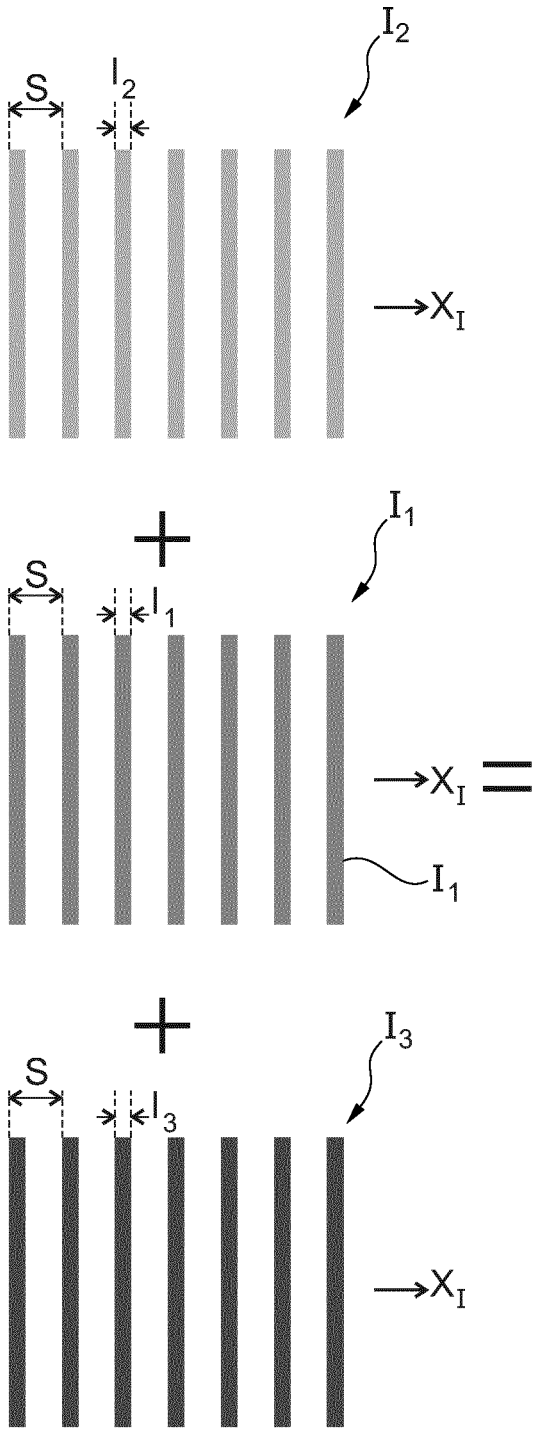
FIG. 1A illustrates the formation of a combined image.

Illustrated in FIG. 1 is an example of forming a combined image I by adding together a plurality of interlaced images $I_1, I_2, \ldots, I_n$. Each interlaced image $I_i$ is formed of interlaced image lines $i_i$ arranged in a periodic manner in the direction $X_1$ and of like width $I_i$ constant over their entire length. The interlaced images are of like period S.

Figure 1B:
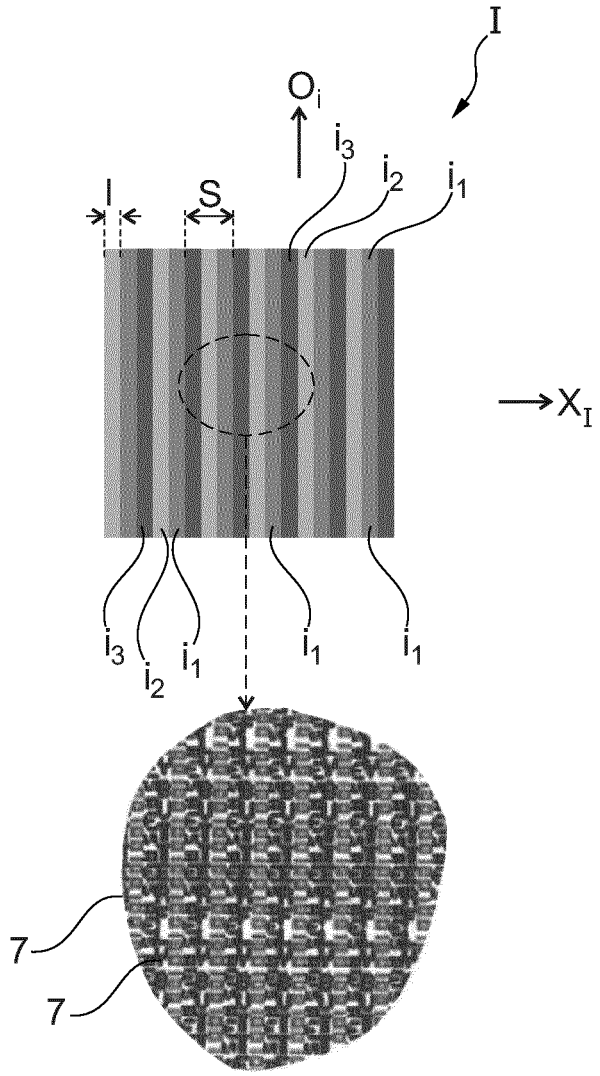
FIG. 1B is an enlarged detail of FIG. 1A.

As illustrated in FIG. 1B representing a detail of the combined image, the lines of the interlaced images $i_1$ to $i_n$ comprise micropatterns 7 such as illustrated in FIG. 1B, in particular are formed by micropatterns 7. The micropatterns 7 of the lines $i_i$ of an interlaced image $I_i$ may be identical.

Preferably, the micropatterns 7 of the lines $i_1$ to $i_n$ belonging to different interlaced images are of different aspects, especially of different shapes and/or of different hues, opacities, luminescences, brightnesses and/or saturations. Preferably, the micropatterns 7 of the lines $i_1$ to $i_n$ belonging to different interlaced images are of different shapes, for example represent different alphanumeric signs and/or are of different hues, opacity, saturation, luminescences or brightnesses, for example of different colors.

Preferably, the micropatterns 7 are of the width l of the lines $i_i$ of the interlaced image and of a height of the same order of magnitude so that, in view of the resolution, the lines $i_i$ appear of a homogeneous color, the micropatterns 7 not being distinguishable to the eye. The user must for example use a magnifying glass to view the micropatterns 7, thereby strengthening the security of the item.

For example, the micropatterns 7 of the lines $i_i$ of an interlaced image may be of a certain hue so that the lines it appear colored in a homogeneous manner.

The micropatterns 7 may be in positive or in negative.

The micropatterns may represent alphanumeric signs, digits, text, geometric shapes, objects, people or animals.

Such micropatterns 7 make it possible to strengthen the security of the item 10 since they form additional security elements hidden in the lines which are not visible to the naked eye. Moreover, the lines are more difficult to counterfeit since they require a high resolution during manufacture, especially during printing.

In the example illustrated in FIG. 1B, the combined image I is formed of three interlaced images $I_1$, $I_2$ and $I_3$ each comprising interlaced-image lines $i_1$, $i_2$ or $i_3$ exhibiting colored micropatterns 7. The lines $i_1$ of the first interlaced image $I_1$ are formed of a repetition of the number "100" in positive writing colored red, the lines $i_2$ of the second interlaced image $I_2$ are formed of a repetition of the word "AWS" in positive writing colored green and the lines $i_3$ of the third interlaced image $I_3$ are formed of a repetition of the word "BUTTERFLY" in positive writing colored blue. To the naked eye, the lines $i_1$ appear red, the lines $i_2$ appear green and the lines $i_3$ appear blue, the micropatterns "100", "AWS" and "BUTTERFLY" not being visible.

Hereinafter in the figures, the micropatterns 7 of the lines $i_1$ to $i_n$ are no longer represented. The lines $i_1$ to $i_n$ are represented as lines of homogeneous aspect but it must be understood that they exhibit micropatterns 7 such as described hereinabove.

The interlaced image lines $i_i$ have parallel longitudinal axes defining a general orientation $O_i$ of the image combined by their general direction. The periodicity is observed along an axis $X_1$ perpendicular to the longitudinal axis of the interlaced image lines.

The combined image I corresponds to the superposition of these interlaced images $I_1$ to $I_n$ while shifting them with respect to one another along the axis $X_1$ so that the interlaced image lines $i_1$ to $i_n$ are not superposed between the various images.

The widths $l_1$ to $l_n$ of the lines of the interlaced images $i_1$ to $i_n$ are such that the sum of the widths $l_1$ to $l_n$ of these lines $i_1$ to $i_n$ is less than or equal to the period S, and preferably, equal to the period S:

$$\sum_{j=1}^{n} lj = S$$

In the example illustrated, the lines of an interlaced image $i_1$ to $i_3$ are of like width $l_1$ to $l_3$ equal to S/3.

As a variant, the lines $i_1$ to $i_n$ of the interlaced images may be of widths $l_1$ to $l_n$ that differ with respect to one another, such as represented in FIG. 8A.

In the example of FIG. 1, the combined image I is formed of three interlaced images $I_1$ to $I_3$. The first interlaced image $I_1$ is formed of a periodic red line $i_1$, the second interlaced image $I_2$ is formed of a periodic green line $i_2$ and the third interlaced image $I_3$ is formed of a periodic blue line $i_3$. The three lines of the interlaced images $i_1$ to $i_3$ are of like width l. The lines of the interlaced images $i_1$ to $i_3$ are rectilinear. The resulting combined image I is a rasterized image exhibiting a periodic alternation of lines $i_1$ to $i_3$ of various colors.

The period S is between 10 μm and 1 mm, preferably between 50 and 200 μm.

The width l of the lines of the interlaced images $i_1$ to $i_n$ is less than or equal to 50 μm, being for example substantially equal to 33 μm. This value corresponds to a resolution of the combined image I of about 800 dpi, this representing a limit for conventional printers which generally have a maximum definition of 600 dpi, and which constitutes a security factor.

Moreover, the human eye not perceiving, at an observation distance of greater than or equal to 30 cm, details of less than approximately 100 μm, a sufficiently fine combined image appears of homogeneous aspect, for example substantially white here in transmitted light.

Hence, whatever the color or colors used for the combined image, the printing definition may be precise enough for the mixture of the colors to appear as homogeneous.

Revealing Raster

In the example illustrated in FIGS. 2A to 3C, the revealing raster 4 is composed of a periodic alternation of constant period Q of straight and occulting raster lines 5*a*, especially of black opaque lines, and of non-occulting lines 5*b*, especially of transparent lines having parallel longitudinal axes. The periodicity is observed along an axis $X_T$ perpendicular to the longitudinal axis of the raster lines 5*a* and 5*b*.

The longitudinal axes of the raster lines 5*a* and 5*b* define a general orientation of the raster $O_t$ by their general direction.

The opaque raster lines 5*a* are of a constant width m which is less than the period Q of the raster and the transparent raster lines 5*b* are of a constant width k which is less than the period Q.

The widths of the opaque raster lines 5*a* and of the transparent raster lines 5*b* may or may not be identical.

In the example illustrated, the raster lines 5*a* and 5*b* have rectilinear and parallel edges, but it may be otherwise. The revealing raster 4 may comprise other patterns such as crenellations or undulations, such as is illustrated respectively in FIGS. 7A and 7B.

The resolution of the revealing raster 4 is, preferably, greater than or equal to 800 dpi.

The revealing raster 4 may be as such of homogeneous aspect to the naked eye and at a normal observation distance, having regard to its fineness. In particular, the revealing raster may appear to the naked eye at 15 cm distance as having a uniform, gray color, which is darker or lighter according to the width in of the opaque raster line 5*a*.

A sufficiently fine combined image and a sufficiently fine revealing raster make it possible to afford anti-photocopy security.

The combined image I and/or the revealing raster 4 may be formed by printing, metallization, demetallization, laser marking, lithography or any other technique making it possible to fix or unveil an image.

To improve security, it is possible to use liquid-crystal inks, for example to print the combined image I. Animation, in order to be revealed, may then require in addition to the revealing raster, the use of a polarizer filter, which may or may not be present on the item.

The revealing raster 4 may be formed by printing or metallization and/or demetallization.

The opaque raster lines 5*a* of the revealing raster 4 may be glossy or matt.

As a variant, not illustrated, the opaque lines of the revealing raster may comprise micropatterns such as those described in conjunction with FIG. 1B.

As a variant, the revealing raster 4 is different, especially the raster lines are not opaque and transparent. The occulting raster lines may be formed of a filter not allowing the wavelengths corresponding to the combined image to pass through and the non-occulting raster lines may allow these wavelengths to pass through at least partially.

Revealed Image

The period Q of the revealing raster 4 is equal to the period S of the combined image I.

When the revealing raster 4 and the combined image I are superposed and the general orientation $O_r$ of the revealing raster 4 is substantially the same as the general orientation $O_i$ of the combined image I, a revealed image $I_r$ may be observed. The revealed image $I_r$ then corresponds to the parts of the combined image I that are present under the transparent raster lines 5*b* for a given angle of observation.

Indeed, when the revealing raster 4 and the combined image I are superposed, under the condition cited previously and when the revealed images are observed on the revealing raster side, the opaque raster lines 5*a* mask one part of the interlaced image lines $i_1$ to $i_n$, the other part of the interlaced image lines $i_1$ to $i_n$ being visible through the transparent raster lines 5*b*. The transparent raster lines 5*b* all allow the viewing of the same proportion ($P_1$; . . . ; $P_n$) of the interlaced image lines $i_1$ to $i_n$. The proportion $P_i$ corresponds to the proportion of a line $i_i$ of the interlaced image $I_i$ that is visible.

In the case where the superposition is observed on the combined image I side, the opaque raster lines 5*a* render the interlaced image lines $i_1$ to $i_n$ on which they are superposed dark and therefore prevent them being viewed. Thus only the interlaced image lines $i_1$ to $i_n$ superposed on the transparent raster lines 4*h* are visible to form the revealed image $I_r$.

Preferably, the revealed images $I_r$ are observable in reflected light and in transmitted light.

Colored Image

In the example of FIGS. 2A to 2C, the interlaced image lines $i_1$ to $i_n$ are all of the same width $I_1$ to $I_n$ and the opaque raster lines 5*a* have a width m equal to twice the width of the interlaced image lines $i_1$ to $i_n$. Thus, the opaque raster lines 5*a*, when they are properly positioned with respect to the interlaced image lines $i_1$ to $i_n$, cover two interlaced images, i.e. two colors, and only one interlaced image, i.e. a single color, is visible. In the case of FIG. 2A, all of the blue is visible and all of the red and the green are hidden, the proportion ($P_1$; . . . ; $P_n$) of the interlaced image lines to in of the revealed image $I_r$ is (0; 0; 1). Likewise for FIG. 2B, the proportion ($P_1$; . . . ; $P_n$) of the interlaced image lines $i_1$ to $i_n$ of the revealed image $I_r$ is (1; 0; 0) and for FIG. 2C, the proportion ($P_1$; . . . ; $P_n$) of the interlaced image lines $i_1$ to $i_n$ of the revealed image $I_r$ is (0; 1; 0).

As a variant, in the example of FIGS. 3A to 3C, the interlaced image lines $i_1$ to $i_n$ are all of the same width $I_1$ to $I_n$ and the opaque raster lines 5*a* have a width in equal to 0.75 times the width of the interlaced image lines $i_1$ to $i_n$. Thus, the opaque raster lines 5*a*, when they are properly positioned with respect to the interlaced image lines $i_1$ to $i_n$, cover three-quarters of one of the interlaced images, i.e. three-quarters of a color; two interlaced images and a quarter of the third interlaced image are therefore visible. In the case of FIG. 3A, all of the blue and the green and a quarter of the red are visible and three-quarters of the red is hidden, the proportion ($P_1$; $P_2$; $P_3$) of the interlaced image lines $i_1$, $i_2$ and $i_3$ of the revealed image $I_r$ is (0.25; 1; 1). Likewise for FIG. 3B, the proportion ($P_1$; $P_2$; $P_3$) of the interlaced image lines $i_1$, $i_2$ and $i_3$ of the revealed image $I_r$ is (1; 0.25; 1) and for FIG. 3C, the proportion ($P_1$; $P_2$; $P_3$) of the interlaced image lines $i_1$, $i_2$ and $i_3$ of the revealed image $I_r$ is (1; 1; 0.25).

The revealed image $I_r$ may appear homogeneous to the naked eye. In the case of a combined image I in the form of a colored raster formed of an alternation of red, green and blue lines of identical widths l and of a revealing raster of width of a transparent raster line k, it is possible to determine the color of the revealed image $I_r$ in RGB coordinates on the basis of the proportion ($P_R$, $P_G$, $P_B$). The RGB coordinates take the form of three numbers lying between 0 and 255 characterizing said color, each number representing the proportion of one of the components red, green and blue making it possible to obtain said color.

The components have coordinates:

$$R=R_{max}*P_R,$$

$$G=G_{max}*P_G, \text{ and}$$

$$B=B_{max}*P_B,$$

with $R_{max}=G_{max}=B_{max}=255*k/S$

It is thus possible to determine the color of the image revealed as a function of the width k of the transparent raster lines 5*b* and of the proportion ($P_R$, $P_G$, $P_B$) of the interlaced images $I_1$, $I_2$ and $I_3$.

The revealed image Ir is observable in transmitted light or in reflected light at one and the same time on the revealing raster 4 side and on the combined image I side when the revealing raster 4 and the combined image I are superposed.

Image Revealed in Pattern Form

In the variant, illustrated in FIGS. 4 to 5D, each interlaced image $I_1$ to $I_n$ comprises a periodic alternation of continuous or discontinuous lines such as are described previously, forming a pattern, for example such as represented in FIG. 4. The pattern may represent a text, alphanumeric signs, ideograms, an object, a person, a plant, a monument and/or an animal. The transparent raster lines 5*b* are of width k equal to the width l of a line of interlaced images. Thus, the revealed image corresponds to one of the interlaced images and may allow, as illustrated in FIGS. 5A to 5D, the observation of at least one pattern of the revealed interlaced image. A change of the conditions of observations corresponding to a relative displacement of the revealing raster 4 with respect to the combined image I along the axis X and/or a change of the angle of observation of the revealing raster 4 and of the combined image I may make it possible to successively observe the various interlaced images $I_1$ to $I_n$, and this may make it possible to give an effect of motion when the interlaced images $I_1$ to $I_n$, each represent the decomposition of a motion.

In the example of FIGS. 4 to 5D, the combined image I comprises four interlaced images $I_1$, $I_2$, $I_3$ and $I_4$ representing various positions of a rotating spiral, such as are represented in FIG. 4. The interlaced-image lines $i_1$, $i_2$, $i_3$ and $i_4$ are discontinuous. The revealing raster 4 allows, when it is superposed with the combined image while having the same orientation, the observation of the spiral of one of the interlaced images $I_1$ to $I_4$, as is illustrated in FIG. 5A.

In the variant illustrated in FIG. 30A, the combined image I comprises a periodic alternation of interlaced-image pixels $p_1$ to $p_n$ in two directions X and Y. The interlaced-image pixels $p_1$ to $p_n$ are of rectangular shape but it could be otherwise. For example the pixels could be of another polygonal shape, especially square, triangle, hexagon or lozenge.

The pixels of FIG. 30A may also be seen as diagonal interlaced image lines formed of pixels joined together by one of their corners alternating periodically in the direction Z.

The preceding description, given for lines, applies to the pixels. Thus, the pixels $p_1$ to $p_n$ belonging to different interlaced images exhibit a different aspect, especially a different hue, saturation, glossiness, transparency, luminescence. For example the pixels $p_1$ to $p_n$ belonging to different interlaced images are of different colors, especially red, green and blue.

The combined image I exhibits a period $S_X$ in the direction $X_I$ and a period $S_Y$ in the direction $Y_I$. Here, the directions $X_I$ and $Y_I$ are perpendicular but it could be otherwise. The directions $X_I$ and $Y_I$ could form a non-zero angle, different from 90°, between themselves.

The interlaced-image pixels $p_1$ to $p_n$ exhibit a dimension $l_X$ and a dimension $l_Y$ in respectively the directions $X_I$ and $Y_I$. The dimensions $l_X$ and $l_Y$ are each such as described previously for the interlaced image lines $i_1$ to $i_n$.

The revealing raster 4 is according to FIG. 30B. It exhibits a periodic alternation of opaque raster pixels 5*a* in two directions $X_T$ and $Y_T$ forming between themselves the same angle as the directions $X_I$ and $Y_I$. The opaque raster pixels 5*a* are separated from one another by transparent gaps 5*b* and repeat according to the periods $S_X$ and $S_Y$ of the combined image in the respective directions $X_T$ and $Y_T$.

The pixels of the revealing raster may be of a dimension $m_X$ and of a dimension my in the respective directions $X_T$ and $Y_T$ which are less than the periods $S_X$ and $S_Y$ respectively.

In the example illustrated, the dimension $m_X$ in the direction $X_T$ is equal to the dimension $l_X$ of the interlaced-image pixels $p_1$ to $p_n$ and the dimension $m_Y$ in the direction $Y_T$ is equal to the dimension $l_Y$ of the interlaced-image pixels $p_1$ to $p_n$.

The dimensions $m_X$ and $m_Y$ may be different respectively from $l_X$ and $l_Y$ on condition that the periods of the revealing raster 4 and of the combined image I are the same in each of the directions X and Y.

Upon superposing the revealing raster 4 and the combined image I so that the directions $X_T$ and $X_I$ coincide and that the directions $Y_T$ and $Y_I$ coincide, the revealing raster makes it possible to observe revealed images $I_r$ such as are represented in FIGS. 30C to 30E.

In the example illustrated the opaque raster pixels 5*a* hide one of the interlaced images $I_1$ to $I_n$ so that two of the interlaced images are visible. In FIG. 30C, the revealed image $I_r$ is formed of the green and red interlaced images, in FIG. 30D, the revealed image $I_r$ is formed of the blue and red interlaced images and in FIG. 30E, the revealed image $I_r$ is formed of the blue and green interlaced images.

The various revealed images $I_r$ illustrated may be obtained by displacing the revealing raster 4 with respect to the combined image in the direction $X_I$, the direction $Y_I$ or the direction Z and/or by changing the angle of view around the directions $X_I$, $Y_I$ or Z.

Observation of a Change of the Revealed Image

It is possible to vary the revealed image $I_r$ observed by changing the conditions of observation of the superposed revealing raster 4 and combined image I, and especially, as is detailed hereinafter, by changing the angle of observation and/or by displacing the revealing raster 4 with respect to the combined image I. Thus, virtually or really, by displacing the combined image I with respect to the revealing raster 4 in the direction X of alternation of the raster lines and of the combined-image lines, the revealed image $I_r$ varies.

By changing the observation conditions, it is possible to pass from FIG. 2A to FIG. 2B and to FIG. 2C. The same holds for FIGS. 3A to 3C and FIGS. 5A to 5D.

By varying the observation conditions, the user may then see a change of the revealed image $I_r$ and conclude in view of this observation as to the authenticity of the item.

In the case where the interlaced images are such as described in conjunction with FIGS. 4 to 5D, the displacement of the revealing raster 4 with respect to the combined image I along the axis X allows the observation successively of the various interlaced images $I_1$ to $I_4$, thereby giving the user the impression that the spiral is rotating about its central axis.

Observation by Superposition on Either Side of a Support

Represented in FIG. 8 is a first embodiment in which a secure item 10 according to the invention comprises a non-opaque, for example perfectly transparent, substrate 20 having a first face 20*a* carrying the combined image I. The second face 20*b* of the substrate 2, opposite to the first face, carries the revealing raster 4.

When the secure item 10 is observed from one side or from the other of the substrate, the revealing raster 4 makes it possible to observe one or more revealed images $I_r$. By changing the angle of observation a, the user changes the observation conditions and the revealed image or images $I_r$ are modified as described previously. For the eye, a change of the angle of observation corresponds to a relative displacement of the revealing raster 4 with respect to the combined image I.

To be able to view all the interlaced images up to an angle of inclination of about 45°, the thickness e of the substrate is, preferably, greater than or equal to approximately the period Q.

For example, if a raster of 100-μm period Q is used, the thickness e of the substrate is greater than 100 μm.

It may be advantageous to have a substrate whose thickness e is less than or equal to 30 μm, better 25 μm, for example lying between 20 and 30 μm, or indeed 20 and 25 μm, bounds included or excluded.

Another possibility for varying the direction of observation of the secure item may be to deform the substrate, for example around a fold axis, as illustrated in FIG. 9.

As the optical system may operate in transmitted or reflected light, it may be used for windows or threads introduced as windows, for example into a banknote.

As a function of the pattern of the revealing raster 4, a tagging of the latter with respect to the combined image I may be necessary, especially in the sense parallel to their general orientation. For example, for a linear revealing raster such as illustrated in FIG. 2, no tagging is necessary; on the other hand, for an undulated raster, a more or less precise tagging, as a function of the amplitude and of the frequency of the undulations, may turn out to be desirable. The invention thus offers a possibility of securing that can be modulated as a function of the protection sought and of the difficulty of implementation.

For secure items comprising a thread introduced as window(s), the combined image I may be obtained by microphotolithography of the thread and the revealing raster 4 may be produced with the help of offset printing with inks crosslinking under UV, performed subsequently when printing the item.

The revealing raster 4 may be associated, if relevant, with a printing pattern of the item.

The pattern of the revealing raster 4 may be printed otherwise than by superposition with the combined image I, on the item, to the same scale or to a different scale.

The printing of the revealing raster 4 may overrun the combined image I and extend over the secure item 10, as illustrated in FIG. 10.

Several revealing rasters and combined images, having for example the form of small squares or rectangles with sides of a few millimeters, may be present in one and the same security thread 30, as illustrated in FIG. 11.

When the revealing raster 4 and the combined image I are on a thread integrated as window(s), as illustrated in FIGS. 12A and 12B, the secure item 10 may comprise at least two windows 31 and 32 making it possible to observe respectively each of the faces of the thread, in reflection.

The substrate of the item may comprise at the level of the windows 31 and 32 material voids and transparent regions 35 and 36 allowing the observation of the revealed images from both sides of the secure item 10.

The interlaced images are observable through the revealing raster 4 from the window 31 side and with the revealing raster as background, from the window 32 side.

The item 10 may also comprise a through window 31, as represented in FIG. 12D, the revealing raster 4 and the combined image I being situated at least partially in this through window. In this way, it is possible to observe the revealed images at one and the same time from the recto side and from the verso side of the secure item 10.

The revealing raster 4 and the combined image in the form of a security thread may further be incorporated into a secure item 10 which exhibit an alternation of windows 31 and 32 recto side and verso side, as illustrated in FIG. 12C. It is thus possible to observe the revealed images at one and the same time on the recto side and on the verso side of the secure item 10 at the level of the windows 31 and 32, and especially on account of the presence of the material voids and the transparent regions 35 and 36.

Represented in FIG. 13 is an exemplary secure item 10 comprising a perforation 40 in which two sub-elements, especially in the form of foils or patches, 41 and 42, are at least partially placed.

The sub-element 41 comprises for example a revealing raster 4 and the sub-element 42 comprises for example the corresponding combined image I.

The sub-elements 41 and 42 may be at least partially superposed on the boundaries of the perforation 40 with or without a thickness compensation.

The sub-elements 41 and 42 may be at least partially transparent or translucent.

The observation of the revealed images may be done by observation in reflection or in transmission, for example with the aid of a light source situated behind the item 10 during observation.

In the variant illustrated in FIG. 14, the secure item 10 comprises a combined image I produced in the form of prints. The prints are for example produced on the surface of the secure item 10. Moreover, a sub-element 43, especially in the form of a foil or patch, is placed on the prints constituting the combined image I, the sub-element 43 comprising the corresponding revealing raster 4, for example produced on the surface of the sub-element 43.

The secure item 10 may or may not be opaque. The secure item 10 may be at least partially transparent or translucent to allow observation of the interlaced images, especially on the combined image I side.

In the examples of FIGS. 13 and 14, the revealing rasters 4 and/or the combined images I could be produced differently, being for example incorporated or situated above or below the sub-elements 41, 42 and 43.

As a variant, the combined image comprises two metallizations of various colors, each corresponding to an interlaced image, especially a copper interlaced image and an aluminum interlaced image.

As a further variant, the combined image comprises at least two metallizations, especially of the same color, of various optical densities and each corresponding to an interlaced image, thus creating a glossiness contrast.

The aluminum interlaced image may be of high optical density, thereby giving it a glossy aspect.

The revealing raster 4 may be of matt aspect.

Superposition of the combined image I and of the revealing raster 4 makes it possible to obtain matt or glossy revealed images $I_{r1}$ to $I_{rg}$.

Observation by Folding the Document or Superposing the Document and Another Object In a second embodiment, illustrated in FIG. 15, the secure item 10 comprises a window 50, preferably at least partially transparent, in which the revealing raster 4 is featured. The item 10 also comprises a combined image I carried on the item 10, for example by printing, especially copper-plate printing, offset printing or metallization and/or demetallization. The region in which the combined image 2 is featured may also be at least partially transparent.

To observe the revealed image, the user must therefore fold the secure item 10, as illustrated in FIG. 17, to bring the revealing raster 4 onto the combined image I so that their general orientation is the same and then observe the revealed image or images $I_r$. Thus, the revealed images are not visible when the item 10 is not folded and an action by the user, namely folding the secure item 10, is necessary in order to make them appear. This makes it possible to strengthen the security of the item 10.

In FIG. 16, the secure item 10 comprises a window 50, preferably at least partially transparent, in which the combined image I is featured. The item 10 also comprises a patch 55 comprising for example holographic prints and in which the revealing raster 3 is featured. The patch 55 may also be at least partially transparent.

The patch 55 may comprise metallizations and/or demetallizations, made for example of aluminum, and the revealing raster 4 may comprise holographic prints and/or metallizations and/or demetallizations.

In FIG. 18, the item 10 comprises a window 50, preferably at least partially transparent, on which the revealing raster 4 is featured. The item 10 also comprises a security thread 60 on which the combined image I is featured. The security thread 60 may also be at least partially transparent or comprise a partially transparent region at the level of the combined image I.

Represented in FIGS. 19 to 23 are other examples of secure item 10 according to the invention comprising a combined image I and a revealing raster 4 in accordance with those of FIGS. 15 and 16, the combined image I and/or the revealing raster 4 being carried by at least one security thread or foil.

In FIG. 19, the item 10 comprises a security thread 60 of a sufficient width to cause combined images I and revealing rasters 4 to be featured in alternation. Advantageously, the security thread 60 is at least partially transparent or exhibits one or more at least partially transparent regions at the level of the combined images I and/or of the revealing rasters 4.

Figure 20:
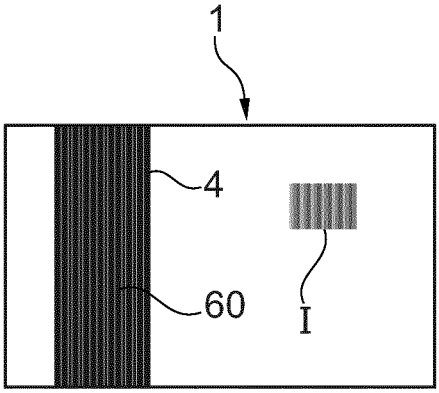

In FIG. 20, the item 10 comprises a security thread 60 on which a revealing raster 4 is featured. The item 10 also comprises a combined image I, for example in the form of an offset print on the item 10.

The security thread 60 may be at least partially transparent or exhibit an at least partially transparent region. The item 10 may also comprise an at least partially transparent region at the level of the combined image I.

Figure 21:
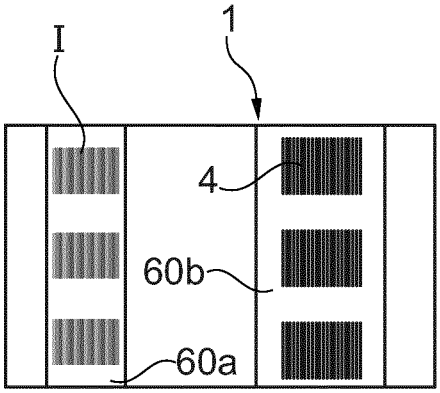

In FIG. 21, the item 10 comprises two security threads 60*a* and 60*b*. The security thread 60*a* comprises three combined images I and the security thread 60*b* comprises three revealing rasters 4.

The security thread 60*a* and/or the security thread 60*b* may be at least partially transparent or comprise at least one at least partially transparent region, especially at the level of a combined image I or of a revealing raster 4.

Figure 22:
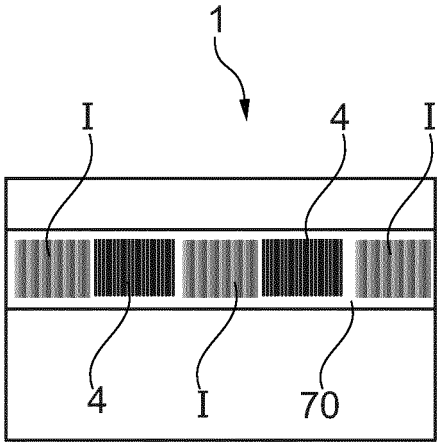

In FIG. 22, the item 10 comprises a foil 70 on which an alternation of combined images I and of revealing rasters 4 is featured.

The foil 70 may be at least partially transparent or comprise at least one at least partially transparent region at the level of a combined image I and/or of a revealing raster 4.

Figure 23:
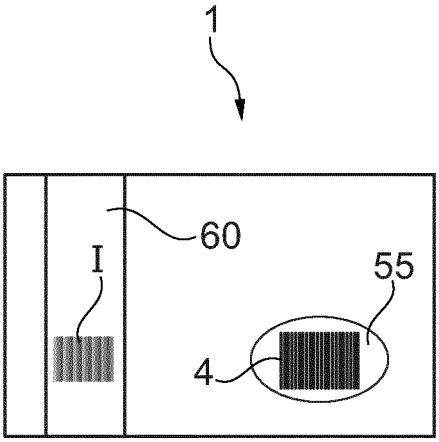

In FIG. 23, the item 10 comprises a security thread 60 on which a combined image I is featured. The item 10 also comprises a patch 55, able to comprise holographic metallizations or otherwise, on which a revealing raster 4 is featured.

The security thread 60 may be at least partially transparent or comprise an at least partially transparent region at the level of the combined image I.

The patch 55 may also be at least partially transparent, especially at the level of the revealing raster 4.

In all the examples described previously, the combined images I and the revealing rasters 4 may be swapped.

The at least partially transparent regions may be situated at the level of the combined images I or of the revelation means 4, or at the level of both at one time.

The security thread or threads 60, 60*a* and 60*b* may be introduced into the secure item 10 in a conventional manner, for example at the surface, bulk-wise or as window(s).

The authentication of the items 10 may be done by folding the items 10 lengthways or widthways so as to at least partially superpose the combined images I and the revealing rasters 4, and then to displace relative to one another so as to view for example the illusion of a motion and/or to modify the angle of observation of the combined images I and of the revealing rasters 4 superposed.

As a further variant, it is also possible to superpose the item 10 at least partially with another similar item, such as described previously.

Imager

Represented in FIGS. 24 to 26 are examples of association between a secure item 10 and an electronic imager 100 making it possible to form the revealing raster 4 or the combined image I.

In FIG. 24, the electronic imager 100 is for example a computer screen on which a first image 110 is displayed, the first image 110 being the revealing raster 4 or the combined image I.

The secure item 10 is for example in the form of a banknote and comprises a second image 120, the second image being the revealing raster 4 if the first image is the combined image and vice versa.

The secure item 10 is placed on the screen of the electronic imager 100 in such a way as to superpose the first image 110 at least partially with the second image 120 so as to observe the revealed image or images $I_r$ and deduce therefrom an authentication and/or identification piece of information in respect of the secure item 10.

The secure item 10 may be displaced relative to the screen of the electronic imager 100 or the observer may change angle of observation to allow the observation of a change of the revealed image or images $I_r$.

As a variant, the referenced secure item 10 remains immobile with respect to the screen of the electronic imager 100 and the first image 110 is animated with a motion on the screen, for example a translation, for example with the aid of a program activated or not by the user.

In FIG. 25, the electronic imager 100 is for example in the form of a digital projector, projecting a first image 110 onto a background 150, for example the wall of a room.

The secure item 10 comprising the second image 120 may then be at least partially superposed with the first image 110 projected onto the background 150 to allow observation of the revealed image or images $I_r$.

In FIG. 26, the electronic imager 100 is a projector which projects the first image 110 directly on the secure item 10.

The first image 110 may, as in the example of FIG. 26, be projected, for example in the form of a "W", on a region of the secure item 10 where the second image 120 is not present. Next, the secure item 10 is for example folded on itself in such a way as to superpose the second image 120, for example in the form of an "A", with the first image 110 projected by the electronic imager 100. The part of the secure item 10 comprising the second image 120 may in particular be folded down onto the part comprising the first image 110, this part remaining immobile, in such a way that the first image 110 is situated between the imager 100 and the second image 120.

In a variant, not represented, the first image 110 is projected directly on the second image 120 of the item 10. In particular, the projection of the first image 110 on the second image 120 of the item 10 may allow an at least partial superposition of the first and second images. Next, the electronic imager 100 may be displaced relative to the item 10 so as to displace the revealing raster 4 with respect to the combined image I.

Represented in FIG. 27 is a variant embodiment in which the electronic imager 100 is a screen displaying several first images 110*a*, 110*b*, 110*c* and 110*d*.

The first images 110*a* to 110*d* may have different properties, for example different shapes, colors, dimensions, raster elements, in particular dots or lines.

Advantageously, the first images 110*a* to 110*d* are differentiated in such a way as to allow one of them at least to be associated with at least one second image 120 present on an item 10. In this way, it is for example possible to authenticate and/or identify a greater diversity of items 10 having different respective second images, corresponding to the various first images 110*a* to 110*d*.

As a variant, the item 10 comprises several different second images 120, as may be seen for example in FIG. 11, and the electronic imager 100 produces one or more first images 110. In this way, it is for example possible to authenticate and/or to identify a given security item 1 on a greater diversity of different electronic imagers, and especially with electronic imagers having different resolutions. In this way, the two advantages previously described may be brought together.

The electronic imager 100 may display one or more indicators 140*a*, 140*b*, 140*c* and 140*d* making it possible to advise the user on the way to position the item 10 represented in FIG. 28 with respect to the imager.

In particular, the indicators 140*a* to 140*d* may make it possible to know where to position the top right corner of the item 10, so as to correctly superpose a second image 120 of an item 10 with a first image 110*a*, 110*b*, 110*c* or 110*d* displayed on the screen of the electronic imager 100.

The item 10 may comprise an integrated microcircuit 152, for example an RFID or optical chip, making it possible to communicate with the electronic imager 100 so as to control the display of an indicator such as described previously or to disseminate a piece of information on the way to position the first and second images.

As a variant, the chip 152 is able to communicate with the electronic imager 100 so as to make it possible to produce the first image 110 associated with the second image 120.

In particular, during the method for authenticating and/or identifying the item 10, the second image 120 is illuminated with the electronic imager 100. The chip 152 comprises a piece of information transmitted to the electronic imager 100 which then projects or displays the first image 110 as a function of this piece of information.

The item 10, especially the second image 120, may be photographed and/or filmed by a digital camera belonging or linked to the electronic imager 100. A recognition program may then make it possible to recognize the second image 120 and to acquire from a database a first image 110 associated with the second image 120. The database is for example stored on a secure server. The first image 110 thus obtained is displayed and/or projected by the electronic imager 110 so as to make it possible to authenticate and/or to identify the item 10.

As a variant illustrated in FIG. 29, the electronic imager 100 takes the form of a mobile telephone on which is displayed a first image 110 in the form of a combined image I. The item 10 comprises a polarizing filter on which the second image 120 has been formed in the form of a revealing raster 4. The item 10 comprising the second image 120 in the form of a revealing raster 4 is superposed with the first image 110 in the form of a combined image I produced by the electronic imager 100, the latter emitting polarized light.

The item 10 comprising the revealing raster 4 may be displaced by a translation motion along the axis X with respect to the combined image I displayed by the screen of the electronic imager 100, in such a way as to change the revealed image or images $I_r$.

Such a method makes it possible to authenticate and/or to identify the security item 1 according to several security levels.

The positioning of the revealing raster 4 comprising the polarizing filter according to the orientation making it possible to observe the opacity of the polarizing filter, this observation being visible only on a screen emitting a polarized light, for example a screen of the LCD type, affords a first level of security.

The revealing of the animation of the revealed images by displacement of the revealing raster 4 relative to the combined image I affords a second level of security.

As a further variant, the electronic imager 100 is a screen, especially of the LCD type, comprising a plurality of pixels preferably forming a combined image, for example such as described in FIG. 30A.

The invention is not limited to the examples illustrated. The secure item may be produced with other securities of first, second or third level, for example.

The expression "comprising a" should be understood as being synonymous with "comprising at least one".

The invention claimed is:

1. A secure item comprising a revealing raster and a combined image, the combined image being composed of a plurality of interlaced images, each interlaced image and the revealing raster being composed of a plurality of elements, the revealing raster making it possible, when it is superposed with the combined image, to observe different revealed images by displacing the revealing raster with respect to the combined image and/or by changing an angle of observation a, the revealed images each comprising a certain proportion of each interlaced image, and the elements being composed of one or more micropatterns, the micropatterns belonging to different interlaced images being different through their colors, hues, opacities, saturations or luminescences or brightnesses.

2. The item as claimed in claim 1, all the elements of all the interlaced images and/or of the revealing raster being composed of one or more micropatterns.

3. The item as claimed in claim 1, the elements of the interlaced images and/or of the revealing raster each being composed of several micropatterns.

4. The item as claimed in claim 1, the micropatterns exhibiting at least one dimension of less than or equal to 1 mm.

5. The item as claimed in claim 1, the micropatterns belonging to different interlaced images being different through their aspects and exhibiting a contrast and/or a sufficient colorimetric difference to make it possible to distinguish two adjacent interlaced-image elements when they are observed with a certain enlargement.

6. The item as claimed in claim 5, the micropatterns belonging to different interlaced images being of different shapes and/or of different colors.

7. The item as claimed in claim 1, the combined image exhibiting a resolution of greater than or equal to 800 dpi.

8. The item as claimed in claim 1, the elements of a same interlaced image appearing of a same color but of a different color from those of the other interlaced images.

9. The item as claimed in claim 1, the interlaced image comprising a periodic alternation of elements of interlaced images in one or more direction, each revealed image corresponding to an interlaced image.

10. The item as claimed in claim 1, the interlaced image comprising a periodic alternation of elements of interlaced images in one or more direction, each revealed image corresponding to an interlaced image, the item being disposed in such a way that when the revealing raster and the combined image are superposed, the directions in which the raster elements alternate periodically and the directions in which the interlaced-image elements alternate periodically are identical.

11. The item as claimed in claim 1, being disposed in such a way that the revealed images are observable in reflected light and/or in transmitted light.

12. The item as claimed in claim 1, being disposed in such a way that the revealed images are observable at one and the same time on the side of the revealing raster and on the side of the combined image.

13. The item as claimed in claim 1, the revealed images forming macropatterns exhibiting different aspects.

14. The item as claimed in claim 1, one at least of the combined image and of the revealing raster featuring on a region of the secure item, a superposition of the revealing raster and of the combined image being performed by folding of the security document, the revealing raster making it possible, when superposed at least partially with the combined image of the secure item, to observe different revealed images through a relative displacement of the revealing raster with respect to the combined image in a or one of directions of the combined image and of the revealing raster.

15. The item as claimed in claim 1, the revealing raster and the combined image being superposed by being separated from one another by a gap of constant thickness.

16. The item as claimed in claim 15, being disposed in such a way that the revealing raster makes it possible to observe different revealed images upon a change of the direction a observation of the secure item.

17. A method for authenticating a secure item according to claim 1, in which the revealed image is observed through the revealing raster, the angle of observation and/or the position of the revealing raster are/is changed with respect to the combined image so as to observe a change of the revealed image and it is concluded as regards an authenticity of the security item in view of an observed change of image.

18. An assembly comprising a secure item and another object, the secure item comprising one of the revealing raster and of the combined image and the object comprising or forming the other of the revealing raster and of the combined image, the combined image being composed of a plurality of interlaced images, each interlaced image and/or the revealing raster being composed of a plurality of elements, the revealing raster making it possible, when it is superposed with the combined image, to observe different revealed images by displacing the revealing raster with respect to the combined image and/or by changing an angle of observation a, the revealed images each comprising a certain proportion of each interlaced image, and the elements being composed of one or more micropatterns, the micropatterns belonging to different interlaced images being different through their colors, hues, opacities, saturations or luminescences or brightnesses.

19. The assembly as claimed in claim 18, the other object being an electronic imager making it possible to form a first image, the first image being the revealing raster or the combined image, so as to be able to superpose it with a second image of the secure item, the second image being the other of the revealing raster and of the combined image.

20. The item as claimed in claim 18, one at least of the combined image and of the revealing raster featuring on a region of the at least partially transparent object, the superposition of the revealing raster and of the combined image being performed by a superposition of the security document with the other object, the revealing raster making it possible, when superposed at least partially with the combined image of the secure item or of the other object, to observe different revealed images through a relative displacement of the revealing raster with respect to the combined image in the or one of the directions of the combined image and of the revealing raster.

* * * * *